US008010350B2

(12) United States Patent
Zopf

(10) Patent No.: US 8,010,350 B2
(45) Date of Patent: Aug. 30, 2011

(54) DECIMATED BISECTIONAL PITCH REFINEMENT

(75) Inventor: Robert W. Zopf, Rancho Santa Margarita, CA (US)

(73) Assignee: Broadcom Corporation, Irvine, CA (US)

( * ) Notice: Subject to any disclaimer, the term of this patent is extended or adjusted under 35 U.S.C. 154(b) by 1151 days.

(21) Appl. No.: 11/734,824

(22) Filed: Apr. 13, 2007

(65) Prior Publication Data

US 2008/0033585 A1 Feb. 7, 2008

Related U.S. Application Data

(60) Provisional application No. 60/835,097, filed on Aug. 3, 2006.

(51) Int. Cl.

| | |
|---|---|
| ***G10L 11/04*** | (2006.01) |
| ***G10L 11/00*** | (2006.01) |
| ***G10L 19/14*** | (2006.01) |
| ***G10L 19/00*** | (2006.01) |

(52) U.S. Cl. ..... 704/207; 704/200; 704/205; 704/206; 704/211; 704/216; 704/218

(58) Field of Classification Search ..... 704/200, 704/205–207, 211, 216–218
See application file for complete search history.

(56) References Cited

U.S. PATENT DOCUMENTS

| | | | | |
|---|---|---|---|---|
| 5,812,967 | A * | 9/1998 | Ponceleon et al. | 704/207 |
| 5,864,795 | A * | 1/1999 | Bartkowiak | 704/216 |
| 6,018,706 | A * | 1/2000 | Huang et al. | 704/207 |
| 6,199,035 | B1 * | 3/2001 | Lakaniemi et al. | 704/207 |
| 6,351,730 | B2 * | 2/2002 | Chen | 704/229 |
| 6,470,310 | B1 * | 10/2002 | Oshikiri et al. | 704/207 |
| 6,885,986 | B1 * | 4/2005 | Gigi | 704/207 |
| 7,155,386 | B2 * | 12/2006 | Gao | 704/216 |
| 7,383,176 | B2 * | 6/2008 | Yasunaga et al. | 704/219 |
| 7,593,847 | B2 * | 9/2009 | Oh | 704/207 |
| 7,672,836 | B2 * | 3/2010 | Lee et al. | 704/207 |
| 7,752,038 | B2 * | 7/2010 | Laaksonen et al. | 704/207 |
| 2003/0177002 | A1 * | 9/2003 | Chen | 704/207 |
| 2004/0102965 | A1 * | 5/2004 | Rapoport | 704/207 |
| 2006/0143002 | A1 * | 6/2006 | Ojanpera | 704/207 |
| 2008/0091418 | A1 * | 4/2008 | Laaksonen et al. | 704/217 |

* cited by examiner

*Primary Examiner* — James S. Wozniak
*Assistant Examiner* — Paras Shah
(74) *Attorney, Agent, or Firm* — Fiala & Weaver P.L.L.C.

(57) ABSTRACT

A method and system for refining an estimated pitch period estimate based on a coarse pitch useful for performing frame loss concealment in an audio decoder as well as for other applications. A normalized correlation at the coarse pitch lag is computed and used as the current best candidate. The normalized correlation is then evaluated at the midpoint of the refinement pitch range on either side of the current best candidate. If the normalized correlation at either midpoint is greater than the current best lag, the midpoint with the maximum correlation is selected as the current best lag. After each iteration, the refinement range is decreased by a factor of two and centered on the current best lag. This bisectional search continues until the pitch has been refined to an acceptable tolerance or until the refinement range has been exhausted. During each step of the bisectional pitch refinement, the signal is decimated to reduce the complexity of computing the normalized correlation.

31 Claims, 22 Drawing Sheets

DECIMATED BISECTIONAL PITCH REFINEMENT

CROSS-REFERENCE TO RELATED APPLICATIONS

This application claims priority to provisional U.S. Patent Application No. 60/835,097, filed Aug. 3, 2006, the entirety of which is incorporated by reference herein.

BACKGROUND OF THE INVENTION

1. Field of the Invention

The present invention relates to a method for estimating a pitch period in a system for coding and decoding speech and/or audio signals.

2. Background Art

In the field of speech coding, nearly all speech codecs require an estimate of the pitch period. During the encoding process, most of the popular predictive speech coding schemes, such as Code-Excited Linear Prediction (CELP) and Multi-Pulse Linear Predictive Coding (MPLPC) exploit the long-term correlation between speech samples at the pitch period present during voiced speech. Transform-based speech coding schemes such as Sinusoidal Transform Coding (STC) typically analyze the speech in the frequency-domain and extract a model-based set of parameters often including the pitch, frequency content, phase information, and energy level. In all of these systems, obtaining an accurate estimate of the pitch is critical to the performance.

In speech or audio coding, the coder converts an input signal into a compressed bit stream, usually partitioned into frames. These frames are either stored or transmitted after which the decoder converts the compressed frames into an output audio signal. During storage or transmission, the frames may be corrupted, lost, or received too late for playback. If this occurs, the decoder must attempt to conceal the effects of the lost frame. Often the signal processing techniques employed involve extrapolation of previously received waveforms to fill the void of the lost frame. If the previous signal is determined to be sufficiently periodic, the extrapolation is periodic. In this case, an accurate estimate of the pitch period in the previously buffered signal is required.

There are several known methods for pitch estimation. A common time-domain approach involves searching for the largest correlation or normalized correlation within a suitable range of the target pitch range. Frequency domain approaches also exist which involve identifying the peaks in the magnitude spectrum. Without regard for complexity, these straightforward approaches can be very complex. A common approach is to break up the pitch estimation into two steps. In the first step, a rough estimate of the pitch period is obtained, yielding a "coarse pitch". In the final step, the coarse pitch is refined using more accurate signal processing techniques. A common first-step method is to first decimate the signal and perform pitch estimation on the decimated signal. Due to the reduced time resolution of the decimated signal, the pitch period is refined using the undecimated signal, but the search range is constrained about the coarse pitch.

In some applications, the pitch estimate computed in one time frame is used to estimate the pitch period in the adjacent time frame. This estimated pitch period is then refined within a limited search range. This technique takes advantage of the approximate short-term stationarity of speech signals. This technique is common in speech/audio coding systems which segment the speech frame into smaller frames or subframes.

In this case, the pitch is estimated within the frame and used as a basis for pitch estimates in subsequent subframes.

The method of refining the estimated pitch period based on a coarse estimate is a very common and successful approach to reducing the complexity of pitch estimation. However, the pitch refinement step may present a significant complexity load in itself, depending on the accuracy of the coarse pitch. In the case of obtaining a coarse pitch estimate by signal decimation, the decimation factor determines the time resolution of the pitch estimate, and hence, the range of refinement required. Where a pitch estimate computed in one time frame is used as the basis for pitch refinement in another timeframe, the time separation between original estimate and pitch refinement determines the range of refinement. The more the frames are separated, the more range is required in the pitch refinement to account for pitch track deviation.

SUMMARY OF THE INVENTION

The present invention achieves low complexity pitch refinement using a combination of signal decimation and a bisectional search of the correlation around the coarse pitch lag.

An embodiment of the present invention uses the following procedure to refine the pitch period estimate based on a coarse pitch. A normalized correlation at the coarse pitch lag is computed and used as the current best candidate. The normalized correlation is then evaluated at the midpoint of a refinement pitch range on either side of the current best candidate. If the normalized correlation at either midpoint is greater than the current best lag, the midpoint with the maximum correlation is selected as the current best lag. After each iteration, the refinement range is decreased by a factor of two and centered on the current best lag. This bisectional search continues until the pitch has been refined to an acceptable tolerance or until the refinement range has been exhausted. During each step of the bisectional pitch refinement, the signal is decimated to reduce the complexity of computing the normalized correlation. The decimation factor is chosen such that enough time resolution is still available to select the correct lag at each step. Hence, the decimated signal contains increasing time resolution as the bisectional search refines the pitch and reduces the search range.

It should be noted that the present invention is not limited to the area of pitch refinement only. For examples, there are other areas and fields in which the technique of simultaneously decimating and using a bisectional search in accordance with an embodiment of the present invention may be applied. For example, a technique in accordance with an embodiment of the present invention can be used to refine any parameter that can be estimated from a down-sampled version of an original signal by a feature that is locally monotonically increasing or decreasing toward a minimum or maximum value that is being searched for.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form a part of the specification, illustrate one or more embodiments of the present invention and, together with the description, further serve to explain the purpose, advantages, and principles of the invention and to enable a person skilled in the art to make and use the invention.

Figure 1:
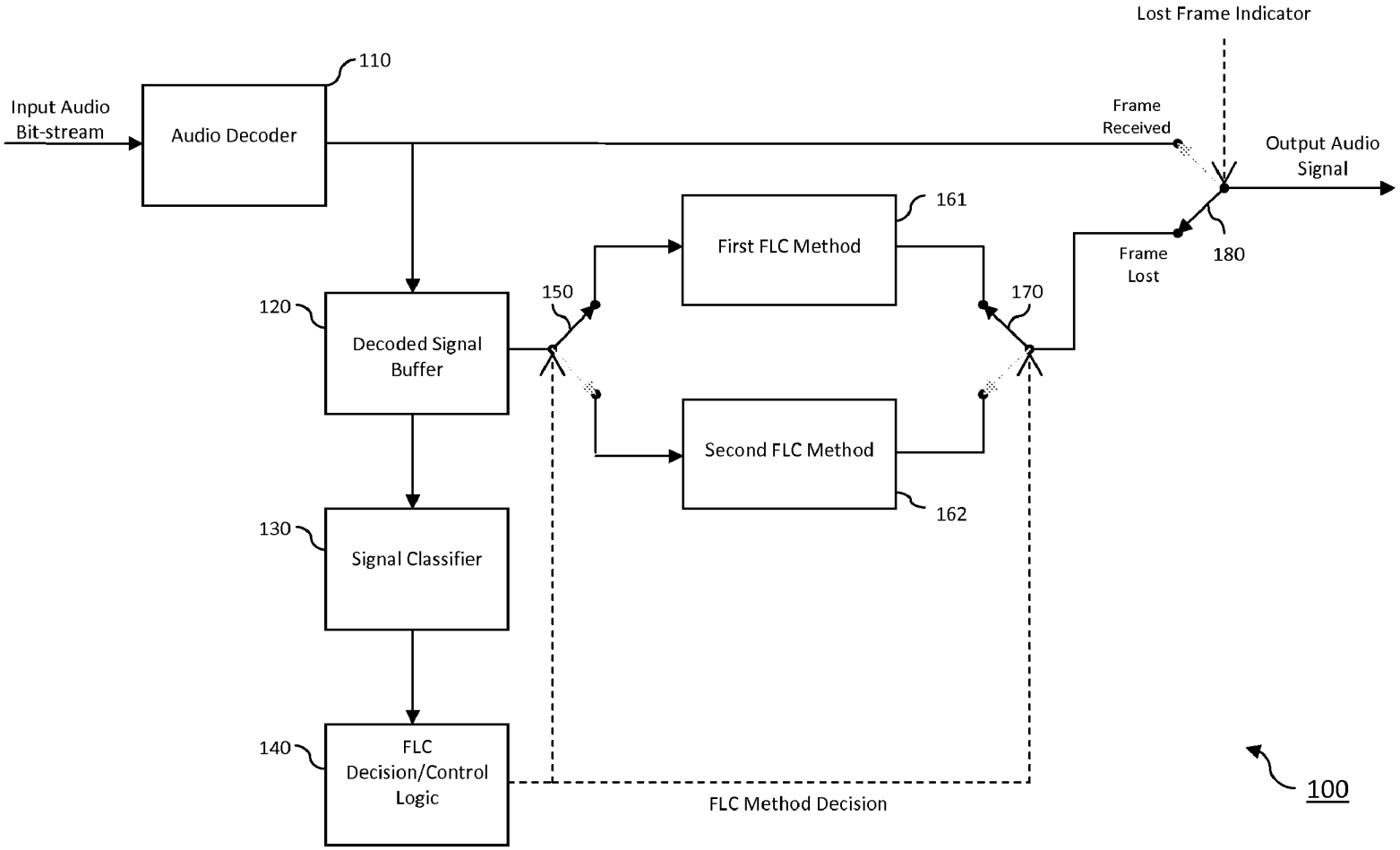
FIG. 1 illustrates an audio decoding system that performs classification-based frame loss concealment (FLC) system in accordance with an embodiment of the present invention.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF INVENTION

A. Improved Classification-Based FLC System and Method in Accordance with an Embodiment of the Present Invention FIG. 1 illustrates an audio decoding system 100 that performs classification-based frame loss concealment (FLC) in accordance with an embodiment of the present invention. As shown in FIG. 1, audio decoding system 100 includes an audio decoder 110, a decoded signal buffer 120, a signal classifier 130, FLC decision/control logic 140, first and second FLC method selection switches 150 and 170, FLC processing blocks 161 and 162, and an output signal selection switch 180. As will be readily appreciated by persons skilled in the relevant art(s), each of the elements of system 100 may be implemented as software, as hardware, or as a combination of software and hardware. In one embodiment of the present invention, each of the elements of system 100 is implemented as a series of software instructions that, when executed by a digital signal processor (DSP), perform the functions of that element as described herein.

In general, audio decoding system 100 operates to decode each of a series of frames of an input audio bit-stream into corresponding frames of an output audio signal. System 100 decodes the input audio bit-stream one frame at a time. As used herein, the term "current frame" refers to a frame of the input audio bit-stream that system 100 is currently decoding, whereas "previous frame" refers to a frame of the input audio bit-stream that system 100 has already decoded. As also used herein, the term "decoding" may include both normal decoding of a received frame of the input audio bit-stream into corresponding output audio signal samples as well as generating output audio signal samples for a lost frame of the input audio bit-stream using an FLC technique. The function of each of the components of system 100 will now be described in more detail.

If a current frame of the input audio bit-stream is deemed received, audio decoder 110 decodes the current frame using any of a variety of known audio decoding techniques to generate output audio signal samples. Output signal selection switch 180 is controlled by a lost frame indicator, which indicates whether the current frame of the input audio bit-stream is deemed received or is lost. If the current frame is deemed received, switch 180 is placed in the upper position shown in FIG. 1 (connected to the node labeled "Frame Received") and the decoded audio signal at the output of audio decoder 110 is used as the output audio signal for the current frame. Additionally, if the current frame is deemed received, the decoded audio signal for the current frame is also stored in decoded signal buffer 120 in preparation for possible FLC operations for future frames.

In contrast, if the current frame of the input audio bit-stream is deemed lost, then output signal selection switch 180 is placed in the lower position shown in FIG. 1 (connected to the node labeled "Frame Lost"). In this case, signal classifier 130 and FLC decision/control logic 140 operate together to select one of two possible FLC methods to perform the necessary FLC operations.

As shown in FIG. 1, there are two possible FLC methods that audio decoding system 100 can use. These two possible FLC methods are implemented in first and second processing blocks 161 and 162, respectively, in FIG. 1. In one embodiment of the invention, processing block 161 (labeled "First FLC Method") is designed or tuned to perform FLC for an audio signal that has been classified as speech, while processing block 162 (labeled "Second FLC Method") is designed or tuned to perform FLC for an audio signal that has been classified as music.

The function of signal classifier 130 is to analyze the previously-decoded audio signal stored in decoded signal buffer 120, or a portion thereof, in order to determine whether the current frame should be classified as speech or music. There are several approaches discussed in the related art that are appropriate for performing this function. In one embodiment, a signal classifier 130 is used that shares a feature set with one or both of the incorporated FLC methods of processing blocks 161 and 162 to reduce complexity.

FLC decision/control logic 140 selects the FLC method for the current frame based on a classification output from signal classifier 130 and other decision logic. FLC decision/control logic selects the FLC method by generating a signal (labeled "FLC Method Decision" in FIG. 1) that controls the operation of first and second FLC method selection switches 150 and 170 to apply either the FLC method of processing block 161 or the FLC method of processing block 162. In the particular example shown in FIG. 1, switches 150 and 170 are in the uppermost position so that the FLC method of processing block 161 is selected. Of course, this is just an example. For a different frame that is lost, FLC decision/control logic 140 may select the FLC method of processing block 162.

If signal classifier 130 classifies the input signal as speech, FLC decision/control logic 140 performs further logic and analysis to determine which FLC technique to use. In one example implementation, signal classifier 130 passes FLC decision/control logic 140 a feature set used in performing speech classification. FLC decision/control logic 140 then uses this information along with the knowledge of the FLC algorithms to determine which FLC method would perform best for the current frame.

Once a particular FLC method is selected, this FLC method uses the previously-decoded audio signal, or some portion thereof, stored in decoded signal buffer 120 and performs the associated FLC operations. The resulting output signal is then routed through switches 170 and 180 and becomes the output audio signal for the audio decoding system 100. Note that although it is not depicted in FIG. 1 for the sake of simplicity, it is understood and generally advisable that the FLC audio signal picked up by switch 170 is also passed back to decoded signal buffer 120 so that the audio signal produced by the selected FLC method for the current lost frame is also stored as the newest portion of the "previously-decoded audio signal." This is done to prepare decoded signal buffer 120 for the next frame in case the next frame is also lost. In other words, it is generally advantageous for decoded signal buffer 120 to store the audio signal corresponding to the last frame immediately processed before a lost frame, whether or not the audio signal was produced by audio decoder 110 or one of FLC processing blocks 161 or 162.

Persons skilled in the relevant art(s) will readily appreciate that the placing of switches 150, 170 and 180 in an upper or lower position as described herein is not necessarily meant to denote the operation of a mechanical switch, but rather to describe the selection of one of two logical processing paths within system 100.

Figure 2:
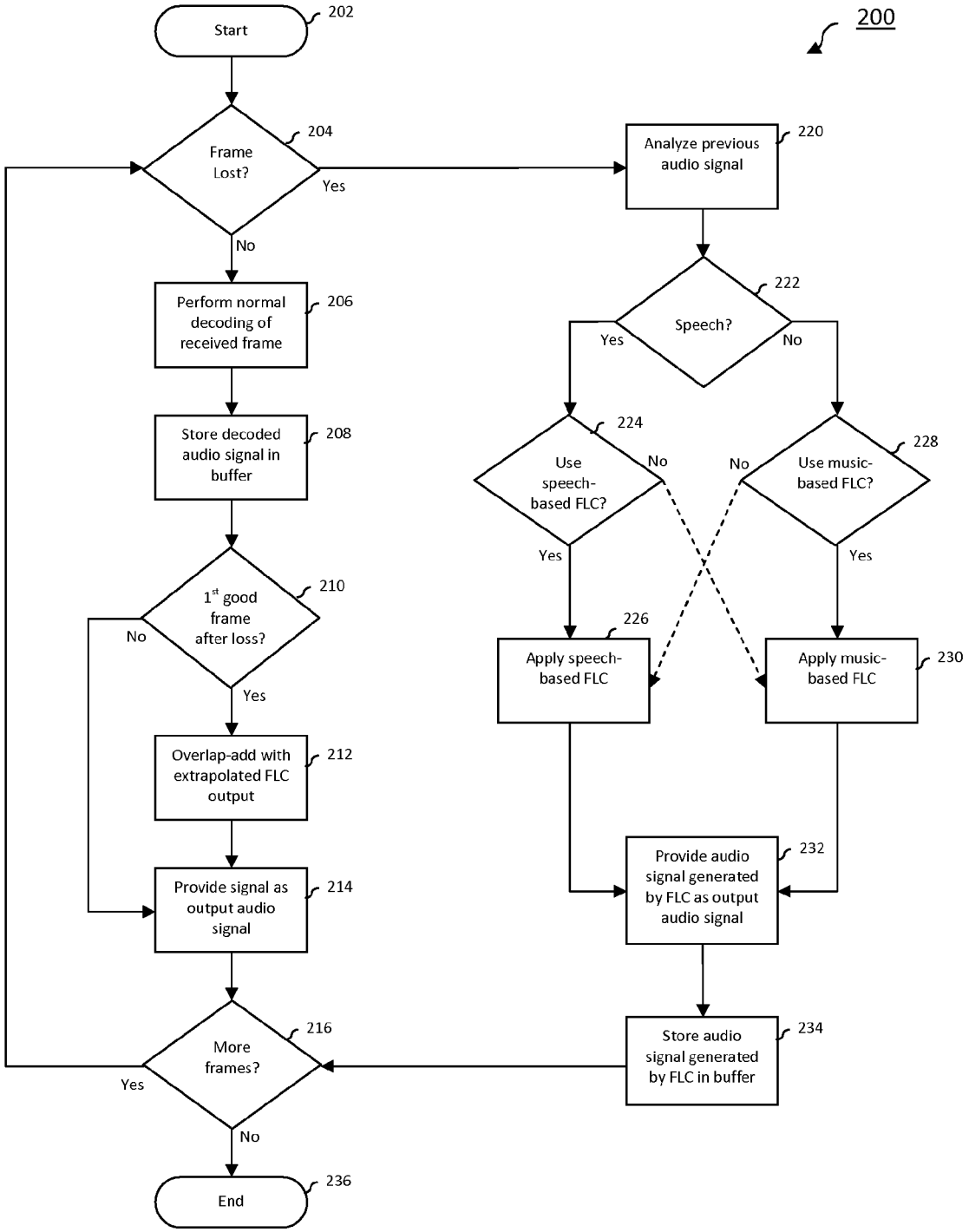
FIG. 2 illustrates a flowchart of a method for performing classification-based FLC in an audio decoding system in accordance with an embodiment of the present invention.

FIG. 2 illustrates a flowchart 200 of a method for performing classification-based FLC in an audio decoding system in accordance with an embodiment of the present invention. The method of flowchart 200 will be described with continuing reference to audio decoding system 100 of FIG. 1, although persons skilled in the relevant art(s) will appreciate that the invention is not limited to that implementation.

As shown in FIG. 2, the beginning of flowchart 200 is indicated at step 202 labeled "start". Processing immediately proceeds to step 204, in which a decision is made as to whether the next frame of the input audio bit-stream to be received by audio decoder 110 is received or lost. If the frame is deemed received, then audio decoder 110 performs normal decoding operations on the received frame to generate corresponding decoded audio signal samples, as shown at step 206. Processing then proceeds to step 208 in which the decoded audio signal corresponding to the received frame is stored in decoded signal buffer 120.

At step 210, a determination is made whether or not this is the first good frame after erasure or loss. If it is, then a portion of the frame and an extrapolated signal provided by one of FLC processing blocks 161 or 162 are overlap-added, as shown in step 212. In an embodiment, a "ramp up" operation is also performed for the first good frame. The overlap-add and ramp up operations will be described in more detail below in reference to the operation of processing blocks 161 and 162.

The decoded audio signal is then provided as the output audio signal of audio decoding system 100, as shown at step 214. With reference to FIG. 1, this is achieved through the operation of output signal selection switch 180 (under the control of the lost frame indicator) to couple the output of audio decoder 110 to the ultimate output of system 100. Processing then proceeds to step 216, where it is determined whether or not there are more frames in the input audio bit-stream to be processed by audio decoding system 100. If there are more frames, then processing returns to decision step 204; otherwise, processing ends as shown at step 236 labeled "end".

Returning to decision step 204, if it is determined that the next frame in the input audio bit-stream is lost, then processing proceeds to step 220, in which signal classifier 130 analyzes at least a portion of the previously decoded audio signal stored in decoded signal buffer 120. Based on this analysis, signal classifier 130 classifies the input signal as either speech or music as shown at step 222. Several approaches have been discussed in the related art that are appropriate for performing this function. In an embodiment of the invention, a classifier is used that shares a feature set with one or both of the incorporated FLC methods of processing blocks 161 and 162 to reduce complexity.

If it is determined in step 222 that the input signal is speech, then FLC decision/control logic 140 performs further logic and analysis to determine which FLC method to apply. In one embodiment, signal classifier 130 passes FLC decision/control logic a feature set used in the speech classification. FLC decision/control logic 140 then uses this information along with knowledge of the FLC algorithms to determine which FLC method would perform best for the current frame. For example, the input signal might be speech with background music and although the predominant signal is speech, there still may be localized frames for which the FLC method designed for music is most suitable. If the FLC method designed for speech is deemed most suitable, the flow continues to step 226, in which the FLC method designed for speech is applied. However, if the FLC method designed for music is selected, the flow crosses over to step 230 and that method is applied. Likewise, if it is determined in step 222 that the input signal is music, FLC decision/control logic 140 then decides which FLC method is most suitable for the current frame, as shown at step 228, and then the selected method is applied. For example, the input signal may be music with vocals and, even though signal classifier 130 has classified the input signal as music, there may be a strong vocal element such that the FLC method designed for speech will provide the best results.

With reference to FIG. 1, the selection of the FLC method by FLC decision/control logic 140 is performed via the generation of the signal labeled "FLC Method Decision", which controls FLC method selection switches 150 and 170 to select one of the processing blocks 161 or 162.

In an embodiment, FLC decision/control logic 140 also uses logic/analysis to control or modify the FLC algorithms. In accordance with such an embodiment, if signal classifier 130 classifies the input signal as speech, and further analysis has a high confidence in the ability of the FLC method designed for speech to conceal the loss of the current frame, then the FLC method designed for speech is selected and left unmodified. However, if further analysis shows that the signal is not very periodic, or that there are indications of some background music, etc., the speech FLC may be selected, but some part of the algorithm may be modified.

For example, if the speech FLC is Periodic Waveform Extrapolation (PWE) based, an effective modification is to use a pitch multiple (double, triple, etc.) for extrapolation. If the signal is speech, using a pitch multiple will still produce an in-phase extrapolation. If the signal is music, using the pitch multiple increases the repetition period and the method becomes more like a frame-repeat method, which has been shown to provide good FLC performance for music signals.

Modifications can also be performed on the FLC method designed for music. For example, if signal classifier 130 classifies the input signal as speech, but FLC decision/control logic 140 selects the FLC method designed for music, the FLC method designed for music may be modified to be more appropriate for speech. For example, the signal can be analyzed for the degree of mix between periodic and noise-like components in a manner similar to that described in U.S. patent application Ser. No. 11/234,291 to Chen (explaining the calculation of a "voicing measure"), the entirety of which has been incorporated by reference herein. The output of the FLC method designed for music can then be mixed with a speech-like derived (LPC analysis) noise signal.

After either the FLC method designed for speech has been applied at step 226 or the FLC method designed for music has been applied at step 230, the audio signal generated by application of the selected FLC method is then provided as the output audio signal of audio decoding system 100, as shown at step 232. In the implementation shown in FIG. 1, this is achieved through the operation of output signal selection switch 180 (under the control of the lost frame indicator) to couple the output at switch 170 to the ultimate output of system 100. The audio signal generated by application of the selected FLC method is also stored in decoded signal buffer 120 as shown in step 234. Processing then proceeds to step 216, where it is determined whether or not there are more frames in the input audio bit-stream to be processed by audio decoding system 100. If there are more frames, then processing returns to decision step 204; otherwise, processing ends at step 236 labeled "end".

Figure 3:
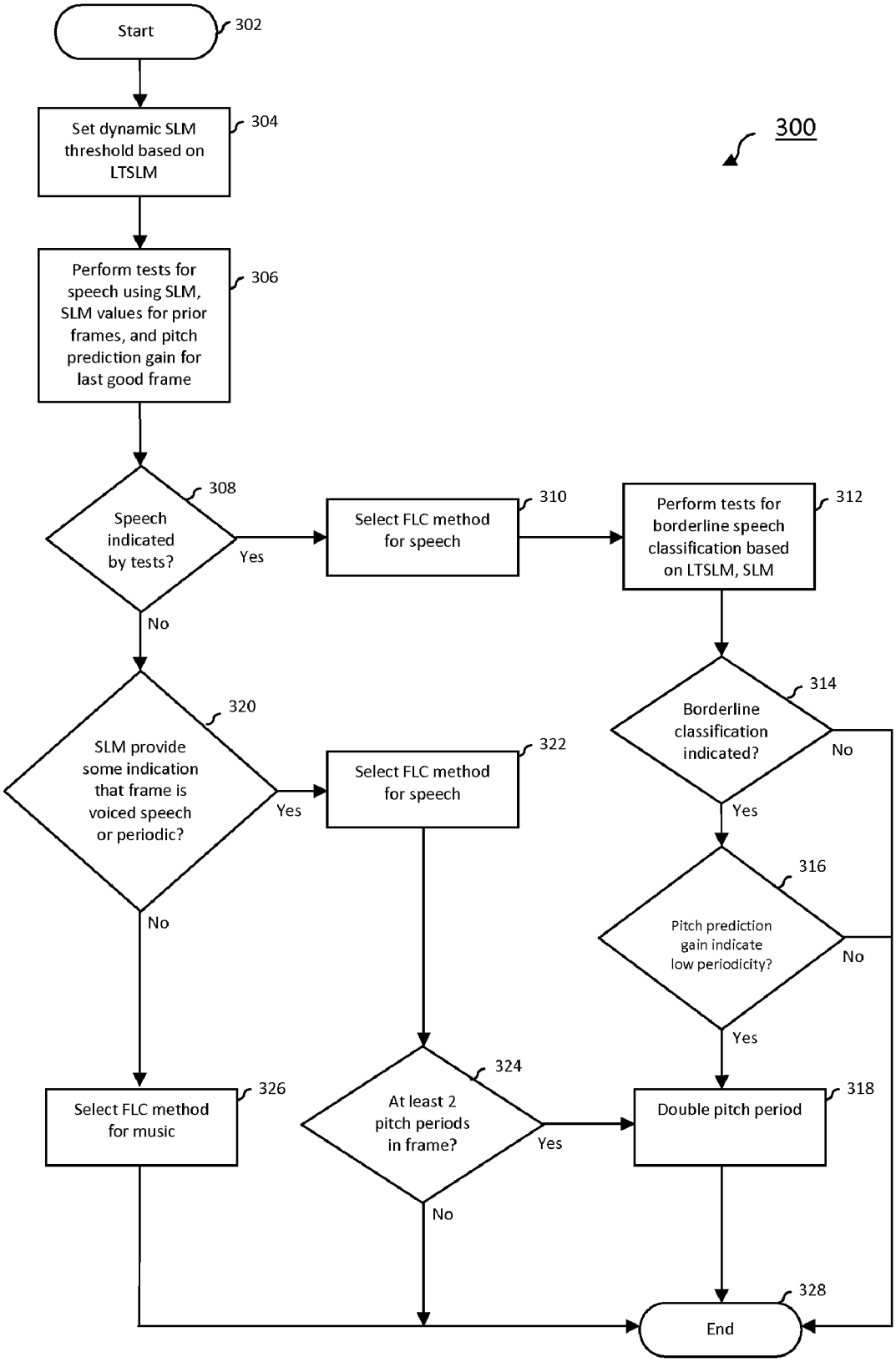
FIG. 3 illustrates a flowchart of a method for determining which of a plurality of FLC methods to apply when a signal classifier has identified an input signal as speech in accordance with an embodiment of the present invention.

FIG. 3 illustrates a flowchart 300 of one method that may be used by FLC decision/control logic 140 for determining which FLC method to apply when signal classifier 130 has identified the input signal as speech. This method utilizes a feature set provided by signal classifier 130, which includes a single speech likelihood measure for the current frame, denoted SLM, and a long-term running average of the speech likelihood measure, denoted LTSLM. The derivation of each of these values is described in Section B below. As discussed in that section, SLM is in the range $\{-4,+4\}$, wherein values close to the minimum or maximum indicate the likelihood of speech, while values close to zero indicate the likelihood of music or other non-speech signals. The method also uses values of SLM associated with previously-decoded frames, which may be stored and subsequently accessed in a local buffer.

As shown in FIG. 3, the beginning of flowchart 300 is indicated by step 302 labeled "start". Processing immediately proceeds to step 304, in which a dynamic threshold for SLM is determined based on LTSLM. In one implementation, this step is carried out by setting the dynamic threshold to $-4$ if LTSLM is greater than 2.18, and otherwise setting the dynamic threshold to $(1.8/\text{LTSLM})^3$ if LTSLM is less than or equal to 2.18. This has the effect of eliminating the dynamic threshold for signals that exhibit a strong long-term tendency for speech, while setting the dynamic threshold to a value that is inversely proportional to LTSLM for signals that do not. As will be made evident below, the higher the dynamic threshold is set, the less likely it is that the method of flowchart 300 will select the FLC method designed for speech.

At step 306, a first series of tests are performed to determine if the FLC method designed for speech should be applied. These tests may include determining if SLM, and/or the absolute value thereof, exceeds a certain threshold, if the sum total of one or more SLM values associated with prior frames exceeds certain thresholds, and/or if a pitch prediction gain associated with the last good frame is large. If true, this last condition would indicate that the frame is very periodic at the detected pitch period and that an FLC method designed for speech would work well. If the results of these tests indicate that the FLC method designed for speech should be applied, then processing proceeds via decision step 308 to step 310, wherein the FLC method designed for speech is selected.

In one implementation, the series of tests applied in step 306 include (1) determining if the absolute value of SLM is greater than 1.8; (2) determining if SLM is greater than the dynamic threshold set in step 304 AND if the one of the following is true: the sum of the SLM values associated with the two preceding frames is greater than 3.4 OR the sum of the SLM values associated with the three preceding frames is greater than 4.8 OR the sum of the SLM values associated with the four preceding frames is greater than 5.6 OR the sum of the SLM values associated with the five preceding frames is greater than 7; (3) determining if the sum of the SLM values associated with the two preceding frames is less than −3.4; (4) determining if the sum of the SLM values associated with the three preceding frames is less than −4.8; (5) determining if the sum of the SLM values associated with the four preceding frames is less than −5.6; (6) determining if the sum of the SLM values associated with the five preceding frames is less than −7; and (7) determining if the pitch prediction gain associated with the last good frame is greater than 6. If any one of tests (1)-(7) is passed (the condition is evaluated as true), then speech is indicated and the FLC method designed for speech is selected.

After the FLC method designed for speech has been selected at step 310, additional tests are performed to see if the pitch period should be doubled prior to application of the FLC method. First, a series of tests are applied to determine if the speech classification is a borderline one as shown at step 312. This series of tests may include determining if SLM is less than a certain threshold and/or determining if LTSLM is less than a certain threshold. For example, in one implementation, these additional tests include determining if SLM is less than 1.4 and if LTSLM is less than 2.4. If either of these conditions is evaluated as true, then a borderline classification is indicated and processing proceeds via decision step 314 to decision step 316. Otherwise, the pitch period is not doubled and processing ends at step 328 labeled "end."

At decision step 316, the pitch prediction gain is compared to a threshold value to determine how periodic the current frame is. If the pitch prediction gain is low, this indicates that the frame has very little periodicity. In one implementation, this step includes determining if the pitch prediction gain is less than 0.3. If decision step 316 determines that the frame has very little periodicity, then processing proceeds to step 318, in which the pitch period is doubled prior to application of the FLC method designed for speech, after which processing ends as shown at step 328. Otherwise, the pitch period is not doubled and processing ends at step 328.

Returning now to decision step 308, if the series of tests applied during step 306 do not indicate speech, then processing proceeds to decision step 320. In decision step 320, SLM is compared to a threshold value to determine if there is at least some indication that the current frame is voiced speech or periodic. If the comparison provides such an indication, then processing proceeds to step 322, wherein the FLC method designed for speech is selected. In one implementation, decision step 308 includes determining if SLM is greater than 1.5.

After the FLC method designed for speech has been selected at step 322, a determination is made as to whether there are at least two pitch periods in the current frame. In one implementation, this is achieved by determining if the frame size divided by the pitch period is greater than two. If there are at least two pitch periods in the current frame, then the pitch period is doubled prior to application of the FLC method designed for speech as shown at step 318, after which processing ends as shown at step 328. Otherwise, the pitch period is not doubled and processing ends at step 328.

Returning now to decision step 320, if the test applied in that step does not provide at least some indication that the current frame is voiced speech or periodic, then processing proceeds to step 326, in which the FLC method designed for music is selected. After this, processing ends at step 328.

Figure 4:
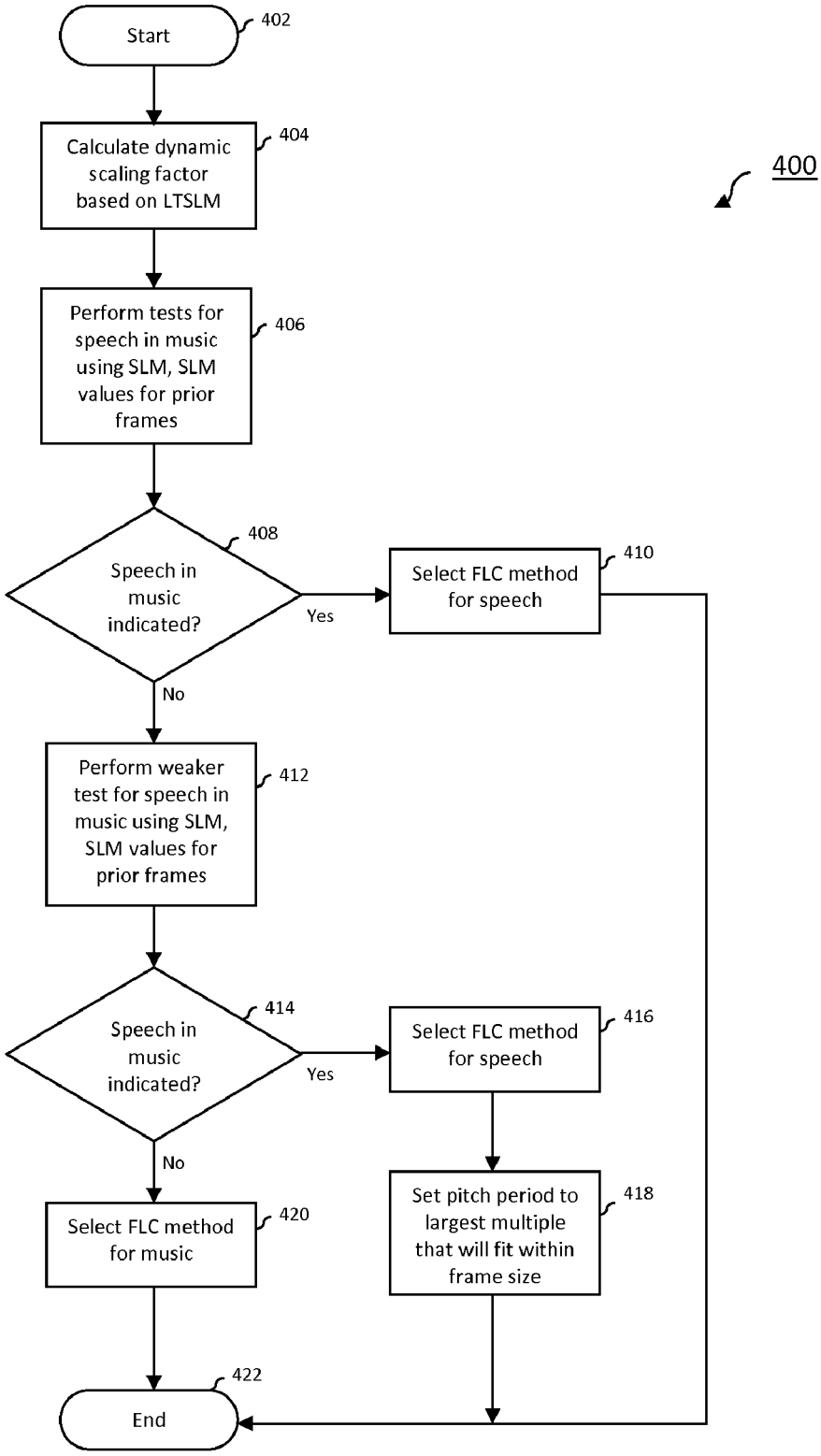
FIG. 4 illustrates a flowchart of a method for determining which of a plurality of FLC methods to apply when a signal classifier has identified an input signal as music in accordance with an embodiment of the present invention.

FIG. 4 illustrates a flowchart 400 of one method that may be used by FLC decision/control logic 140 for determining which FLC method to apply when signal classifier 130 has identified the input signal as music. Like the method described above in reference to flowchart 300 of FIG. 3, this method utilizes a feature set provided by signal classifier 130, which includes a single speech likelihood measure for the current frame, denoted SLM, and a long-term running average of the speech likelihood measure, denoted LTSLM. The method also uses values of SLM associated with previously-decoded frames, which may be stored and subsequently accessed in a local buffer.

As shown in FIG. 4, the beginning of flowchart 400 is indicated by step 402 labeled "start". Processing immediately proceeds to step 404, in which a dynamic scaling factor is determined based on LTSLM. In one implementation, the dynamic scaling factor is set to a value that is inversely proportional to LTSLM. For example, in one implementation, the dynamic scaling factor is set to 1.8/LTSLM. As will be made evident below, the higher the scaling factor, the less likely that the FLC method designed for speech will be selected.

At step 404, a series of tests are performed to detect speech in music and thereby determine if the FLC method designed for speech should be applied. These tests may include determining if SLM exceeds a certain threshold, if the sum total of one or more SLM values associated with prior frames exceeds certain thresholds, or a combination of both. If the results of these tests indicate speech in music, then processing proceeds via decision step 408 to step 410, wherein the FLC method designed for speech is selected. Processing then ends as shown at step 422 denoted "end".

In one implementation, the series of tests performed in step 406 include (1) determining if SLM is greater than 1.8 times the scaling factor determined in step 404 and (2) determining if the sum of the SLM values associated with the three preceding frames is greater than 5.4 times the scaling factor determined in step 404 OR if the sum of the SLM values associated with the four preceding frames is greater than 7.2 times the scaling factor determined in step 404. If both tests (1) and (2) are passed (the conditions are evaluated as true), then speech in music is indicated.

Returning now to decision step 408, if the series of tests applied during step 406 do not indicate speech in music, then processing proceeds to step 412, in which a weaker test for speech in music is performed. This test may include determining if SLM exceeds a certain threshold and/or if the sum total of one or more SLM values associated with prior frames exceeds certain thresholds. For example, in one implementation, speech in music is indicated if SLM is greater than 1.8 and the sum of the SLM values associated with the two preceding frames is greater than 4.0. As shown at decision step 414, if the test of step 412 indicates speech in music, then processing proceeds to step 416, in which the FLC method for speech is selected.

After the FLC method designed for speech has been selected at step 416, the pitch period is set to the largest multiple of the pitch period that will fit within frame size. This is done because there is a weak indication of speech in the recent past but a long-term indication of music. Consequently, the FLC method designed for speech is used but with a larger pitch multiple, thereby making it act more like an FLC method designed for music (e.g., a frame repeat FLC method). After this, processing ends at step 422 labeled "end".

Returning now to decision step 414, if the weaker test performed at step 412 does not indicate speech in music, then the FLC method designed for music is selected as shown at step 420. After this processing ends at step 422.

1. FLC Methods Designed for Speech and Music in Accordance with an Embodiment of the Present Invention As noted above, an embodiment of the present invention includes a processing block 161 that performs an FLC method designed for speech and a processing block 162 that performs an FLC method designed for music. In this section, further detail will be provided about each of these FLC methods and how they are implemented by processing blocks 161 and 162. In addition, a ringing signal computation that is common to both approaches will be described.

The present invention is for use with either audio codecs that employ overlap-add synthesis at the decoder or with codecs that do not, such as PCM. As used herein, AOLA denotes the number of samples in the window used for overlap-add synthesis at the decoder. Thus, for codecs that employ overlap-add synthesis at the decoder, AOLA>0, while for codecs that do not, AOLA=0.

a. Ringing Signal Computation

For both FLC methods described in this section, a "ringing" signal, r, is obtained to maintain continuity between the previously-decoded frame and the lost frame. For the case where there is no audio overlap-add synthesis at the decoder (AOLA=0), this ringing signal is calculated as the zero-input response of a synthesis filter associated with the audio decoder 110. As discussed in U.S. patent application Ser. No. 11/234,291 to Chen, filed Sep. 26, 2005, and entitled "Packet Loss Concealment for Block-Independent Speech Codecs" (the entirety of which is incorporated by reference herein), an effective approach is to use the ringing of the cascaded long-term and short-term synthesis filters of the decoder.

The length of the ringing signal for overlap-add is denoted herein as ROLA. If the pitch period is less than the overlap length, the ringing is computed for one pitch period and then waveform repeated to obtain ROLA samples. The pitch used for ringing, ppr, may be a multiple of the original pitch period, pp, depending on the mode (SPEECH or MUSIC) as determined by signal classifier 130 and the decision logic applied by FLC decision/control logic 140. In one implementation, ppr is determined as follows: if the selected mode is MUSIC and the frame size (FRSZ) is greater than or equal to two times the original pitch period (pp) then ppr is set to two times pp. Otherwise, ppr is set to ppm. As used herein, ppm refers to a modified pitch period that results when the pitch period is multiplied. As discussed above, such multiplication of the pitch period may occur as a result of the operation of FLC decision/control logic 140.

If an audio overlap-add signal is available, there is no zero-input response computation, and the ringing signal is set to the audio fade-out signal provided by the decoder, denoted herein as $A_{out}$.

b. Improved Frame Repeat Method

In accordance with an embodiment of the present invention, the FLC method designed for music is an improved frame repeat method. As discussed in U.S. patent application Ser. No. 11/285,311 to Chen, filed Nov. 23, 2005, and entitled "Classification-Based Frame Loss Concealment for Audio Signals", a frame repeat method combined with the overlapping windows of typical audio coders produces surprisingly sufficient quality for most music.

Figure 5:
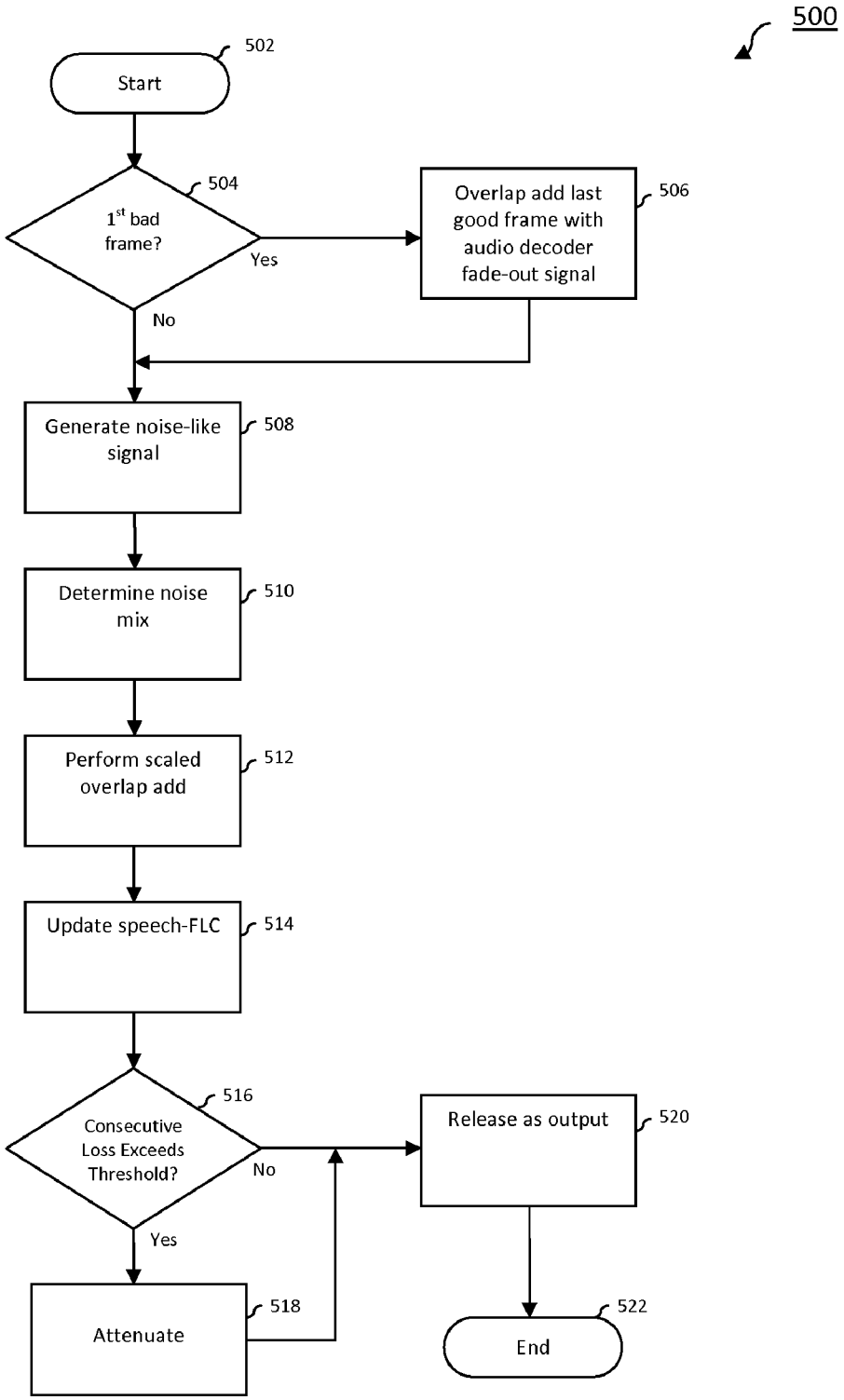
FIG. 5 illustrates a flowchart of a method for performing frame-repeat based FLC for music-like signals in accordance with an embodiment of the present invention.

FIG. 5 is a flowchart 500 illustrating an improved frame repeat method in accordance with an embodiment of the present invention. As shown in FIG. 5, the beginning of flowchart 500 is indicated by a step 502 labeled "start". Processing immediately proceeds to step 504, in which it is determined whether the current frame is the first bad (i.e., erased) frame since a good (i.e., non-erased) frame was received. If so, step 506 is performed. In step 506, the last good frame played out, denoted Lgf, is overlap-added with the ringing signal, r, to form the "correlated" repeat component $fr_{cor}$:

if (AOLA>0)

$$fr_{cor}(n)=Lgf(n)\cdot wc_{in}(n)+r(n)\cdot wc_{out}(n)\ n=0\ldots AOLA-1$$

$$fr_{cor}(n)=Lgf(n)\ n=AOLA\ldots FS-1$$

else $$fr_{cor}(n)=Lgf(n)\cdot wc_{in}(n)+r(n)\cdot wc_{out}(n)\ n=0\ldots ROLA-1$$

$$fr_{cor}(n)=Lgf(n)\ n=ROLA\ldots FS-1$$

where $wc_{in}$ is a correlated fade-in window, $wc_{out}$ is a correlated fade-out window, AOLA is the length in samples of the overlap-add window, ROLA is the length in samples of the ringing signal for overlap-add, and FS is the number of samples in a frame (i.e., the frame size).

The overlap-add is performed with a window containing the following property:

$$wc_{in}(n)+wc_{out}(n)=1.$$

Note that $A_{out}$ likely has a portion or all of $w_{out}$ already applied. Typically, the audio encoder applies $\sqrt{wc_{out}(n)}$ and the decoder does the same. It should be understood that whatever portion of the window has been applied is not reapplied to the ringing signal, r.

At step 508, locally-generated white or Gaussian noise is passed through an LPC filter in a manner similar to that described in U.S. patent application Ser. No. 11/234,291 to Chen (the entirety of which has been incorporated by reference herein), except that in the present embodiment, scaling is applied to the noise signal after it has been passed through the LPC filter rather than before, and the scaling factor is based on the average magnitude of the speech signal associated with the last frame rather than on the average magnitude of the LPC prediction residual signal of the last frame. This step produces a filtered noise signal $n_{lpc}$. Enough samples (FS+OLAG) are produced for the current frame and for an overlap-add window for the first good frame.

At step 510, an appropriate mixture of the repeated signal $fr_{cor}$ and the filtered noise signal $n_{lpc}$ is determined. Many different methods can be used to perform this step. In one implementation, a "voicing measure" or figure of merit (fom) such as that described in U.S. patent application Ser. No. 11/234,291 to Chen is used to compute a scale factor, β, that ranges from 0 to 1. The scale is overwritten to 0 if the current classification from signal classifier 130 is MUSIC.

At step 512, a scaled overlap-add of the repeated signal $fr_{cor}$ and the filtered noise signal $n_{lpc}$ is performed. The scaled overlap-add is preferably performed in accordance with the method described in Section C below. Hence:

$$sq(N+n)=fr_{cor}(n)\cdot(1-\beta)+(A_{out}(n)\cdot wu_{out}(n)+n_{lpc}(n)\cdot wu_{in}(n))\cdot\beta\ n=0\ldots AOLA-1$$

$$sq(N+n)=fr_{cor}(n)\cdot(1-\beta)+n_{lpc}(n)\cdot\beta\ n=AOLA\ldots FS-1$$

where sq is the output signal buffer, N is the position of the first sample of the current frame in the output signal buffer, $fr_{cor}$ is the correlated repeat component, β is the scale factor described in the preceding paragraph, $n_{lpc}$ is the filtered noise signal, $A_{out}$ is the audio fade-out signal, $wu_{out}$ is the uncorrelated fade-out window, $wu_{in}$ is the uncorrelated fade-in window, AOLA is the overlap add window length, and FS is the frame size. Where there is no overlap-add synthesis at the decoder, AOLA=0, and the foregoing simply becomes:

$$sq(N+n)=fr_{cor}(n)\cdot(1-\beta)+n_{lpc}(n)\cdot\beta\ n=0\ldots FS-1.$$

At step 514, denoted "update speech-FLC", any frame-to-frame memory is updated in order to maintain continuity (signal buffer, decimation filters, LPC filters, pitch buffers, etc.).

If the frame erasure lasts for an extended period of time, the output of the FLC scheme is preferably ramped down to zero in a gradual manner in order to avoid buzzy sounds or other artifacts. At step 516, a measure of the time in frame erasure is compared to a predetermined threshold, and if it exceeds the threshold, step 518 is performed which attenuates the signal in the output signal buffer denoted sq(N . . . FS−1). A linear ramp starting at 43 ms and ending at 63 ms is preferably used. Finally, at step 520, the samples in sq(N . . . FS−1) are released to a playback buffer. After this, processing ends as indicated by step 522 labeled "end".

i. Overlap-Add in First Good Frame

As described above in reference to step 212 of FIG. 2, an overlap-add is performed on the first good frame after erasure for both FLC methods. The overlap window length for this step is denoted OLAG herein. If an audio codec that employs overlap-add synthesis at the decoder is being used, this overlap-add length will be the length of the built-in analysis overlap. Otherwise, it is a tuned parameter. The overlap-add is again performed in accordance with a method described below in Section C below. For the improved frame repeat method, the function is:

$$sq(N+n)=(fr_{cor}(n)\cdot wc_{out}(n)+sq(N+n)\cdot wc_{in}(n))\cdot(1-\beta)+$$

$$(n_{lpc}(n+FS)\cdot wu_{out}(n)+sq(N+n)\cdot wu_{in}(n))\cdot\beta\ n=0\ldots OLAG-1$$

where sq is the output signal buffer, N is the position of the first sample of the current frame in the output signal buffer, $fr_{cor}$ is the correlated repeat component, β is the scale factor, $n_{lpc}$ is the filtered noise signal, $wc_{out}$ is the correlated fade-out window, $wc_{in}$ is the correlated fade-in window, $wu_{out}$ is the uncorrelated fade-out window, $wu_{in}$ is the uncorrelated fade-in window, OLAG is the overlap-add window length, and FS is the frame size. It should be noted that sq(N+n) likely has a portion or all of $wc_{in}$ already applied if the frame is from an audio decoder. Typically, the audio encoder applies $\sqrt{wc_{in}(n)}$ and the decoder does the same. It should be understood that whatever portion of the window has been applied is not reapplied.

ii. Gain Attenuation

In a manner similar to that described in U.S. patent application Ser. No. 11/234,291 to Chen, which has been incorporated by reference herein, if the frame erasure lasts too long, the output is attenuated to avoid buzzy artifacts. The gain attenuation duration is from 43 ms to 63 ms.

iii. Ramp Up in First Good Frame

As described above in reference to step 212 of FIG. 2, a "ramp up" operation is performed on the first good frame after erasure for both FLC methods. In particular, in order to avoid an abrupt energy change from FLC frames to the first good frame, the output signal in the first good frame is ramped up from a scale factor associated with a last sample in the previously-described gain attenuation step, to 1, over a period of $$\min(OLAG,0.02*SF)$$

where SF is the sampling frequency.

c. FLC Method Designed for Speech

In an embodiment of the present invention, the FLC method applied by processing block 161 is a modified version of that described in U.S. patent application Ser. No. 11/234,291 to Chen, which is incorporated by reference herein. A flowchart of the modified approach is collectively depicted in FIGS. 6 and 7 of the present application. Because the flowchart is large, it has been divided into two portions, one depicted in FIG. 6 and one depicted in FIG. 7, with a node "A" as the connecting point between the two portions.

Figure 6:
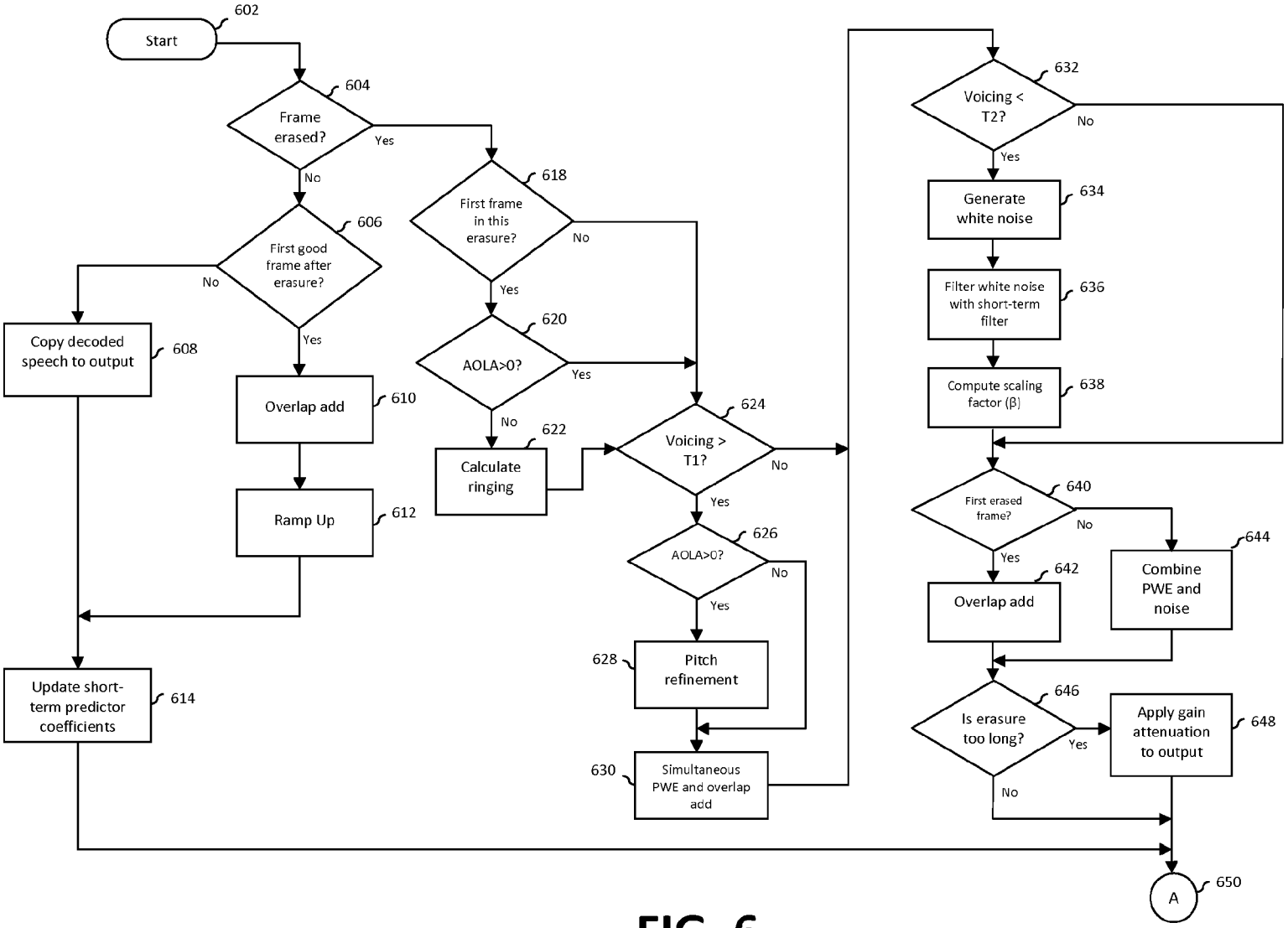
FIG. 6 illustrates a first portion of a flowchart of a method for performing FLC for speech signals in accordance with an embodiment of the present invention.

The method begins at step 602, which is located in the upper left corner of FIG. 6 and is labeled "start". Processing then immediately proceeds to decision step 604, in which it is determined whether the current frame is erased. If the current frame is not erased, then processing proceeds to decision step 606, in which it is determined whether the current frame is the first good frame after an erasure. If the current frame is not the first good frame after an erasure, then the decoded speech samples in the current frame are copied to a corresponding location in the output buffer as shown at step 608.

If it is determined at decision step 606 that the current frame is the first good frame after erasure, then the current frame is overlap added with an extrapolated frame loss signal as shown at step 610. The overlap window length is designated OLAG. If an audio codec that employs overlap-add synthesis at the decoder is being used, this overlap-add length will be the length of the built-in analysis overlap. Otherwise, it is a tuned parameter. The overlap-add is performed in accordance with a method described in Section C below. The function is:

$$sq(N+n)=(1-\beta)\cdot(sq(N+n)\cdot wc_{in}(n)+sq(N+FS+n)\cdot wc_{out}(n))+$$

$$\beta\cdot(sq(N+n)\cdot wu_{in}(n)+n_{lpc}(FS+n)\cdot wu_{out}(n))\ n=0\ldots OLAG-1$$

where sq is the output signal buffer, N is the position of the first sample of the current frame in the output signal buffer, β is a scale factor that will be described in more detail herein, $wc_{out}$ is the correlated fade-out window, $wc_{in}$ is the correlated fade-in window, $wu_{out}$ is the uncorrelated fade-out window, $wu_{in}$ is the uncorrelated fade-in window, OLAG is the overlap-add window length for the first good frame, and FS is the frame size.

After step 610, control flows to step 612 in which a "ramp up" operation is performed on the current frame. In particular, in order to avoid an abrupt energy change from FLC frames to the first good frame, the output signal in the first good frame is ramped up from a scale factor associated with a last sample in a gain attenuation step (described herein in reference to step 648 of FIG. 6) to 1, over a period of $$\min(OLAG,0.02*SF)$$

where SF is the sampling frequency.

After step 608 or 612 is completed, processing proceeds to step 614, which updates the coefficients of a short-term predictor by performing a so-called "LPC analysis", a technique that is well-known by persons skilled in art. One method of performing this step is described in more detail in U.S. patent application Ser. No. 11/234,291. After step 614 is completed, control flows to node 650, labeled "A". This node is identical to node 702 in FIG. 7.

Returning now to decision step 604, if it is determined during this step that the current frame is erased, then processing proceeds to decision step 618, in which it is determined whether the current frame is the first frame in this current stream of erasure. If the current frame is not the first frame in this stream of erasure, processing proceeds directly to decision step 624.

However, if the current frame is the first frame in this stream of erasure, then a determination is made at decision step 620 as to whether or not there is audio overlap-add synthesis at the decoder. If there is no audio overlap-add synthesis at the decoder (i.e., if AOLA=0), then the ringing signal of a cascaded long-term synthesis filter and short-term synthesis filter is calculated at step 622. This calculation is discussed above in Section A.1.a, and described in detail in U.S. patent application Ser. No. 11/234,291 to Chen.

If there is audio overlap-add synthesis at the decoder (i.e., if AOLA>0), then an audio overlap-add signal is available and the ringing signal is not calculated at step 622. Rather, the ringing signal is set to an audio fade-out signal provided by the decoder, denoted $A_{out}$. In either case, control then flows to decision step 624.

At decision step 624, it is determined whether a voicing measure (the calculation of which is described below in reference to step 718 of FIG. 7) has a value greater than a first threshold value T1. If the answer is "No", the waveform in the last frame is considered not periodic enough to warrant doing any periodic waveform extrapolation. As a result, steps 626, 628 and 630 are bypassed and control flows directly to decision step 632. On the other hand, if the answer is "Yes", the waveform in the last frame is considered to have at least some degree of periodicity. Consequently, control flows to decision step 626.

At decision step 626, a determination is made as to whether or not there is audio overlap-add synthesis at the decoder. If there is no audio overlap-add synthesis at the decoder (i.e., if AOLA=0), then processing proceeds directly to step 630. However, if there is audio overlap-add synthesis at the decoder (i.e., if AOLA>0), then pitch refinement based on the audio fade-out signal is performed at step 628 prior to performance of step 630.

The pitch used for frame erasure is that estimated during the last good frame, denoted pp. Due to the local stationarity of speech, it is a good estimate for the pitch in the lost frame. However, due to the time separation between frames, it can be expected that the pitch has deviated from the last frame. As is described elsewhere herein, an embodiment of the invention utilizes an audio fade-out signal to overlap-add with the periodic extrapolated signal. If the pitch has deviated, this can result in the overlapping signals becoming out-of-phase, and to begin to cancel each other. This is especially problematic for small pitch periods. To alleviate the cancellation, step 628 uses the audio fade-out signal to refine the pitch.

Many different methods can be used to refine the pitch. One such method is to maximize the normalized cross correlation between the two signals. In this approach, the signal buffer sq is extrapolated for each pitch candidate and the resulting signal is correlated with the audio fade-out signal. However, at high sampling rates, this approach quickly becomes very complex. A low complexity alternative described in Section D below is preferably used. The sq buffer is extrapolated for each pitch candidate in this reduced complexity method. The initial conditions used are:

$$\Delta_0=\min(127,\lceil pp*0.2\rceil)$$

$$P_0=ppm$$

The final refined pitch will be denoted ppmr. If pitch refinement is not performed at step 628, ppmr is set to equal ppm.

Regardless of whether pitch refinement is performed at step 628, control then flows to step 630. At step 630, the signal buffer sq is extrapolated and simultaneously overlap-added with the ringing signal on a sample-by-sample basis using the refined pitch ppmr. The extrapolation is computed as:

$$sq(N+n)=sq(N+n-ppmr)\cdot wc_{in}(n)+\mathrm{ring}(n)\cdot wc_{out}(n)\ n=0\ldots ROLA-1$$

$$sq(N+n)=sq(N+n-ppmr)\ n=ROLA\ldots FS+OLAG$$

where sq is the output signal buffer, N is the position of the first sample of the current frame in the output signal buffer, ppmr is the refined pitch, $wc_{in}$ is the correlated fade-in window, $wc_{out}$ is the correlated fade-out window, ring is the ringing signal, ROLA is the length in samples of the ringing signal for overlap-add, OLAG is the overlap-add length for the first good frame, and FS is the frame size. Note that $A_{out}$ likely has a portion or all of $wc_{out}$ already applied. Typically, the audio encoder applies $\sqrt{wc_{out}(n)}$ and the decoder does the same. It should be understood that whatever portion of the window has been applied is not reapplied.

Compared to simply extrapolating the signal, this technique is advantageous. It incorporates the original signal fading out into the extrapolation so the extrapolation is closer to the original signal. The successive periods of the extrapolated signal are slightly different due to the incorporated fade-out signal resulting in a significant reduction in buzzy artifacts (these occur when the simple extrapolation results in identical pitch periods which get repeated over and over and are too periodic).

After decision step 624 or step 630 is complete, processing then proceeds to decision step 632, in which it is determined whether the voicing measure (the calculation of which is described below in reference to step 718 of FIG. 7) is less than a second threshold T2. If the answer is "No", the waveform in the last frame is considered highly periodic and there is no need to mix in any random, noisy component in the output audio signal; hence, control flows directly to decision step 640 as shown in FIG. 6.

If, on the other hand, the answer to decision 632 is "Yes", then control flows to step 634. At step 634, a sequence of pseudo-random white noise is generated. Following step 634, the sequence of pseudo-random white noise is passed through a short-term synthesis filter to generate a filtered noise signal, as shown at step 636. The manner in which steps 634 and 636 are performed is described in detail in U.S. patent application Ser. No. 11/234,291 to Chen, except that in the present embodiment, scaling is applied to the noise signal after it has been passed through the short-term synthesis filter rather than before, and the scaling factor is based on the average magnitude of the speech signal associated with the last frame rather than on the average magnitude of the LPC prediction residual signal of the last frame.

After step 636, control flows to step 638 in which the voicing measure is used to compute a scale factor, β, which ranges from 0 to 1. One manner of computing such a scale factor is set forth in detail in U.S. patent application Ser. No. 11/234,291 to Chen. If it was determined at decision step 624 that the voicing measure does not exceed T1, then β will be set to one.

Following decision step 632 or step 638, decision step 640 determines if the current frame is the first erased frame in a stream of erasure. If the current frame is the first frame in the stream of erasure, the audio fade-out signal, $A_{out}$, is combined with the extrapolated signal and the LPC generated noise from step 636 (denoted $n_{lpc}$), as shown at step 642. The signal and the noise are combined in accordance with the scaled overlap-add technique described in Section C below. Hence:

$$sq(N+n)=(1-\beta)\cdot(sq(N+n)\cdot wc_{in}(n)+A_{out}(n)\cdot wc_{out}(n))+\beta\cdot(n_{lpc}(n)wu_{in}(n)+A_{out}(n)\cdot wu_{out}(n))\ n=0\ldots AOLA-1$$

$$sq(N+n)=(1-\beta)\cdot(sq(N+n))+\beta\cdot n_{lpc}(n)\ n=AOLA\ldots FS-1$$

where sq is the output signal buffer, N is the position of the first sample of the current frame in the output signal buffer, β is the scale factor, $n_{lpc}$ is the noise signal, $A_{out}$ is the audio fade-out signal, $wc_{out}$ is the correlated fade-out window, $wc_{in}$ is the correlated fade-in window, $wu_{out}$ is the uncorrelated fade-out window, $wu_{in}$ is the uncorrelated fade-in window, AOLA is the overlap-add window length, and FS is the frame size. Note that if β=0, then only the extrapolated signal and the audio fade-out signal are combined and if β=1, then only the LPC generated noise and the audio fade-out signal are combined.

If it is determined at decision step 640 that the current frame is not the first erased frame in a stream of erasure, then there is no audio fade-out signal, $A_{out}$, for overlapping. Consequently, only the extrapolated signal and the LPC generated noise are combined at step 644 in accordance with:

$$sq(N+n)=(1-\beta)\cdot(sq(N+n))+\beta\cdot n_{lpc}(n)\ n=0\ldots FS-1.$$

In this instance, even though there is no audio fade-out signal for overlapping, a smooth signal transition will still occur at the frame boundary because the ringing signal was overlap-added with the extrapolated signal contained in the output signal buffer during step 630.

After step 642 or step 644 completes, processing proceeds to step 646, which determines whether the current erasure is too long—that is, whether the current frame is too "deep" into erasure. If the length of the current erasure has not exceeded a predetermined threshold, then control flows to node 650 (labeled "A") in FIG. 6, which is the same as node 702 in FIG. 7. However, if the length of the current erasure has exceeded this threshold, then step 648 is performed. Step 648 attenuates the signal in the output signal buffer denoted sq(N . . . FS−1) in a manner similar to that described in U.S. patent application Ser. No. 11/234,291 to Chen. This is done to avoid buzzy artifacts. A linear ramp starting at 43 ms and ending at 63 ms is preferably used.

Figure 7:
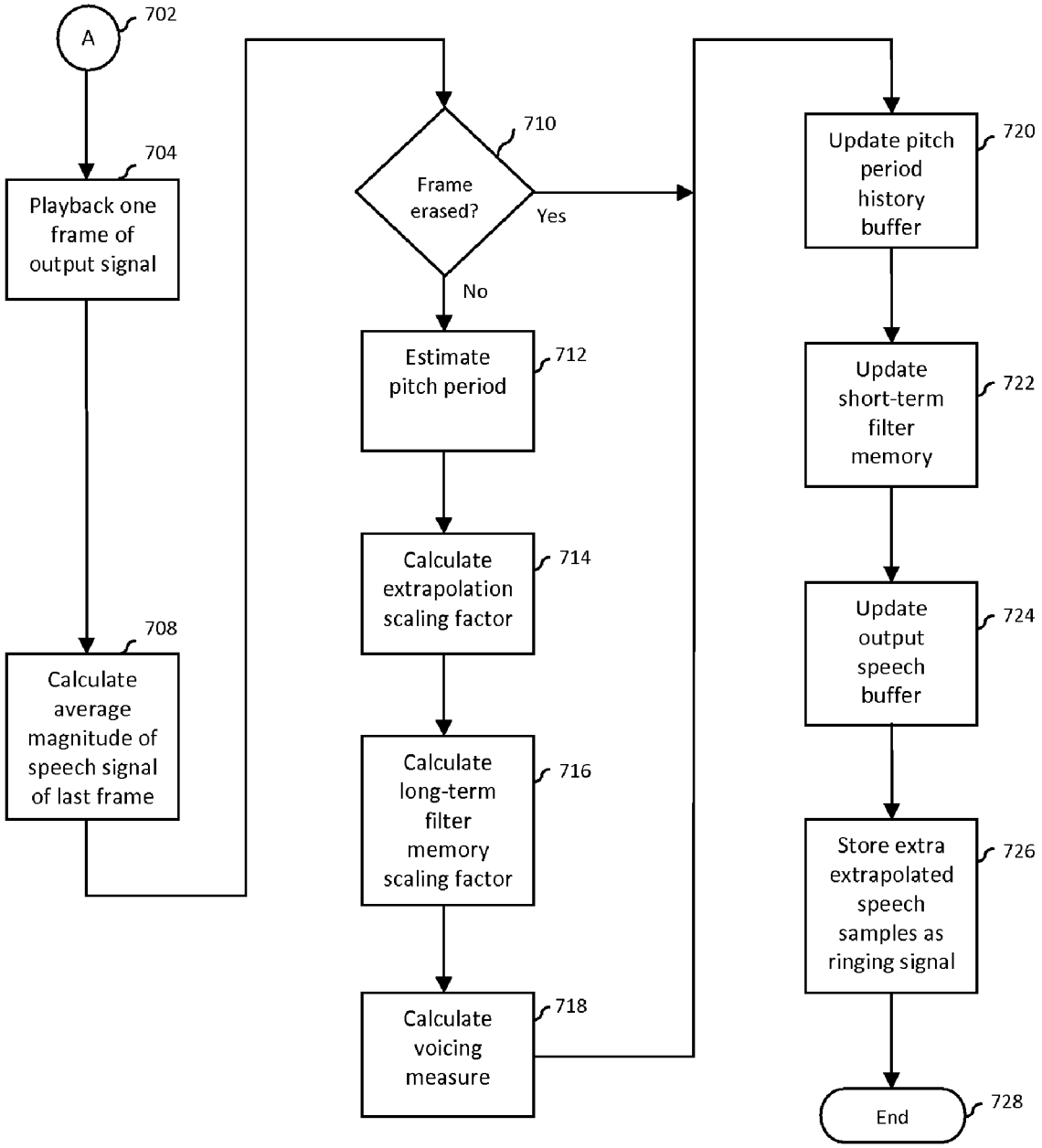
FIG. 7 illustrates a second portion of a flowchart of a method for performing FLC for speech signals in accordance with an embodiment of the present invention.

Turning now to FIG. 7, after the processing in FIG. 6 is done, step 704 and step 708 are performed. Step 704 plays back the output signal samples in output signal buffer, while step 706 calculates the average magnitude of the speech signal associated with the last frame. This value is stored and is later used in step 634 to scale the filtered noise signal.

After step 708, processing proceeds to decision step 710, in which it is determined whether the current frame is erased. If the answer is "Yes", then steps 712, 714, 716 and 718 are skipped, and control flows directly to step 720. If the answer is "No", then the current frame is a good frame, and steps 712, 714, 716 and 718 are performed.

Step 712 uses any one of a large number of possible pitch estimators to generate an estimated pitch period pp that may be used by processes 622, 628 and 630 during processing of the next frame. Step 714 calculates an extrapolation scaling factor that may optionally be used by step 630 in the next frame. In the present implementation, this extrapolation scaling factor has been set to one and thus does not appear in any of the equations associated with step 630. Step 716 calculates a long-term filter memory scaling factor that may be used in step 622 in the next frame. Step 718 calculates a voicing measure on the current frame of decoded speech. The voicing measure is a single figure of merit whose value depends on how strongly voiced the underlying speech signal is. One method of performing each of steps 712, 714, 716 and 718 is described in more detail in U.S. patent application Ser. No. 11/234,291 to Chen.

After decision step 710 or step 718 is done, control flows to step 720. Step 720 updates a pitch period buffer. In one implementation of the present invention, the pitch period buffer is used by signal classifier 130 of FIG. 1 to calculate a pitch period change parameter that is used by signal classifier 130 and FLC decision/control logic 140, as discussed elsewhere herein. After step 720 is complete, step 722 updates a short-term synthesis filter memory that may be used in steps 622 and 636 during processing of the next frame. After step 722 is complete, step 724 performs shifting and updating of the output speech buffer. After step 724 is complete, step 726 stores extra samples of the extrapolated speech signal beyond the need of the current frame as the ringing signal for the next frame. One method of performing each of steps 720, 722, 724 and 726 is described in more detail in U.S. patent application Ser. No. 11/234,291 to Chen.

After step 726, control flows to step 728, which is labeled "end". Node 728 denotes the end of the frame processing loop. Then, the control flow goes back to node 602 labeled "start" to start the frame processing for the next frame.

B. Robust Speech/Music Classification for Audio Signals in Accordance with an Embodiment of the Present Invention Embodiments for classifying audio signals as speech or music are described in the present section. The example embodiments described herein are provided for illustrative purposes, and are not limiting. Further structural and operational embodiments, including modifications/alterations, will become apparent to persons skilled in the relevant art(s) from the teachings herein.

Figure 8:
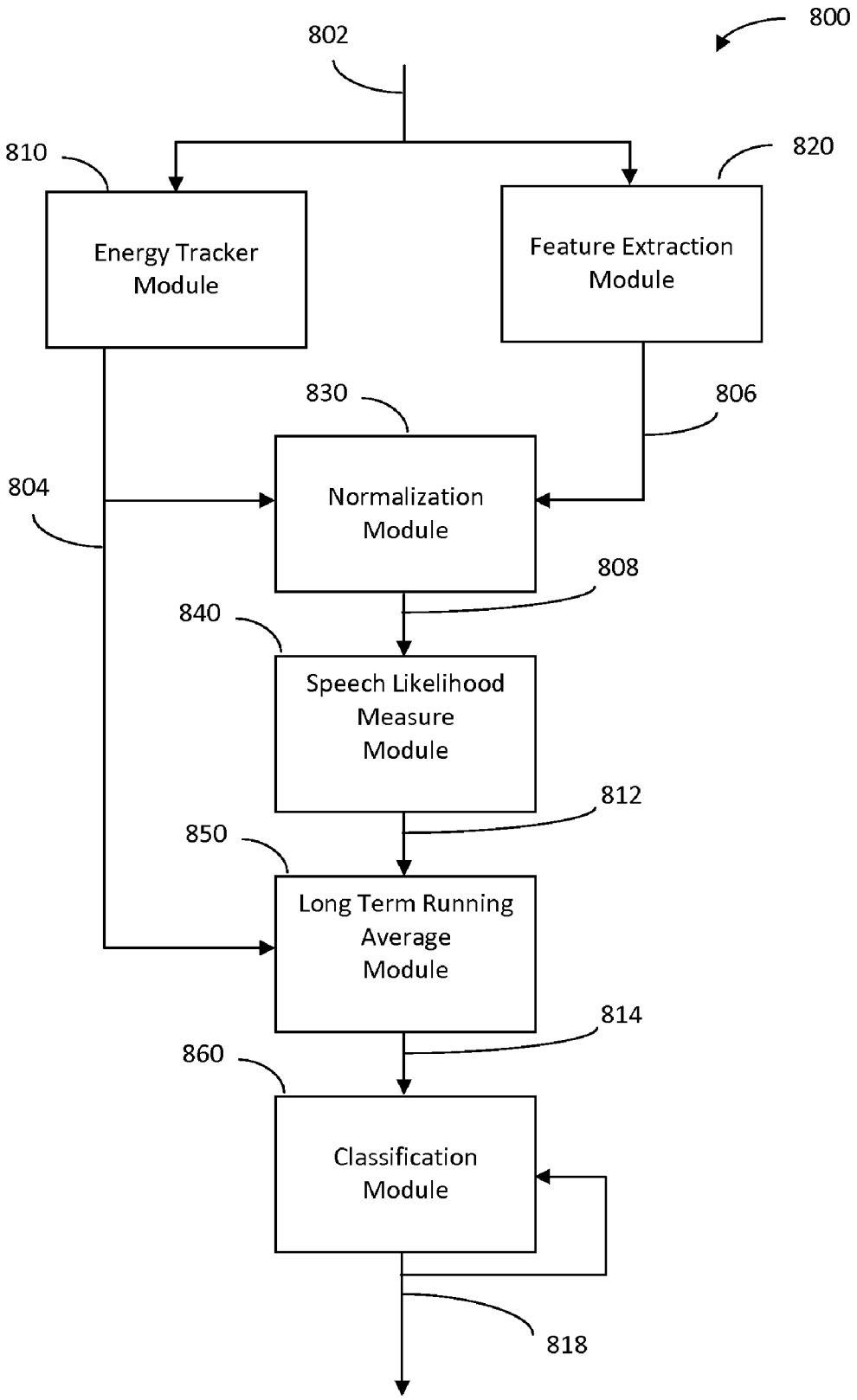
FIG. 8 is a block diagram of a speech/non-speech classifier in accordance with an embodiment of the present invention.

FIG. 8 shows a block diagram of a speech/non-speech classifier 800 in accordance with an example embodiment of the present invention. Speech/non-speech classifier 800 may be used to implement signal classifier 130 described above in reference to FIG. 1, for example. However, speech/non-speech classifier 800 may also be used in a variety of other applications as will be readily understood by persons skilled in the relevant art(s).

As shown in FIG. 8, speech/non-speech classifier 800 includes an energy tracker module 810, a feature extraction module 820, a normalization module 830, a speech likelihood measure module 840, a long term running average module 850, and a classification module 860. These modules may be implemented in hardware, software, firmware, or any combination thereof. For example, one or more of these modules may be implemented in logic, such as a programmable logic chip (PLC), in a programmable gate array (PGA), in a digital signal processor (DSP), as software instructions that execute in a processor, etc.

These various functional components of speech/non-speech classifier 800 will now be described.

1. Energy Tracker Module Embodiments

In embodiments, energy tracker module 810 tracks one or both of a maximum frame energy estimate and a minimum frame energy estimate of a signal frame received on an input signal 802. Input signal 802 is characterized herein as x(n). In an example embodiment, which is further described below, energy tracker module 810 tracks frame energy using a combination of long term and short term minimum/maximum estimators. A final threshold for active signals may be derived from both the minimum and maximum estimators.

One example energy tracking algorithm tracks a base-2 logarithmic signal gain, lg. Note that frame energy is discussed in terms of lg in the following description for illustrative purposes, but may alternatively be referred to in other terms, as would be understood to persons skilled in the relevant art(s).

Signal activity detectors, such as energy tracker module 810, may be used to distinguish a desired audio signal from noise on a signal channel. For instance, in one implementation, a signal activity detector may detect a level of noise on the signal channel, and use this detected noise level as a minimum energy estimate. A predetermined offset value is added to the detected noise level to create a threshold level. A signal level on the signal channel that is above the threshold level is considered to be the desired audio signal. In this manner, signals with large dynamic range (e.g., speech) can be relatively easily distinguished from a noise floor.

However, for signals with a smaller dynamic range (certain music for example), a threshold based on a maximum energy estimate may have better performance. For a smaller dynamic range signal, a tracking system based on a minimum energy estimate may undesirably determine the minimum energy estimate to be roughly equal to lower level audio portions of the audio signal. Thus, portions of the audio signal may be mistaken for noise. In contrast, a signal activity detector based on a maximum energy estimate detects a maximum signal level on the signal channel, and subtracts a predetermined offset level from the detected maximum signal level to create a threshold level. The subtracted offset level can be selected to maintain the threshold level below the lower level audio portions of the audio signal. A signal level on the signal channel that is above the threshold level is considered to be the desired audio signal.

In embodiments, energy tracking module 810 may be configured to track a signal according to these minimum and/or maximum energy estimate techniques. In embodiments where both the minimum and maximum energy estimates are used, energy tracking module 810 provides a meaningful active signal threshold for a wide range of signal types. Furthermore, the tracking of short term estimators and long term estimators (as further described below) enables classifier 800 to adapt quickly to sudden changes in the signal energy profile while at the same time maintaining some stability and smoothness. The determined final active signal threshold is used by long term running average module 850 to indicate when to update the long term running average of the speech likelihood measure. In order to provide accurate classification in the presence of background noise or interfering signals, updates to detected minimum and/or maximum estimates are performed during active signal detection.

Figure 9:
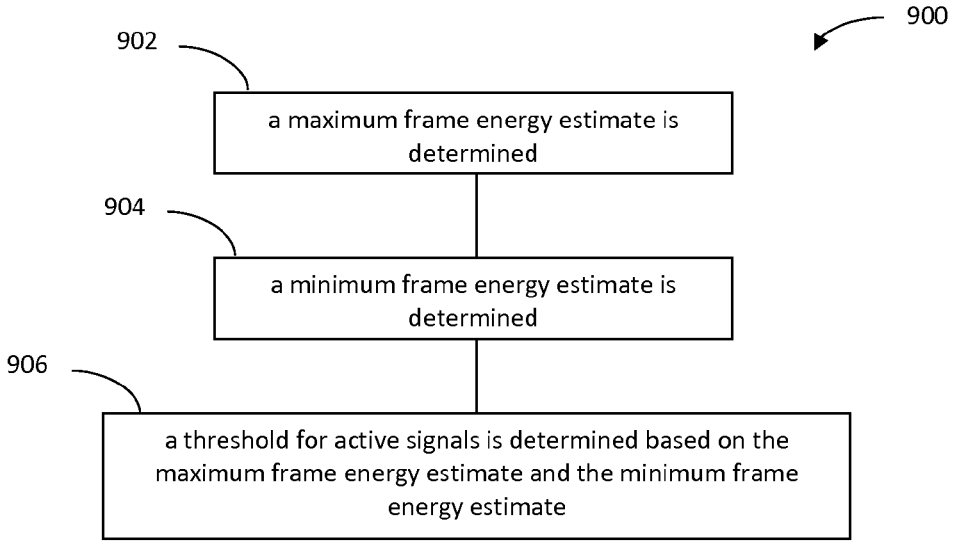
FIG. 9 shows a flowchart providing example steps for tracking energy of an audio signal, according to embodiments of the present invention.

FIG. 9 shows a flowchart 900 providing example steps for tracking energy of an audio signal, according to example embodiments of the present invention. Flowchart 900 may be performed by energy tracking module 810, for example. The steps of flowchart 900 need not necessarily occur in the order shown in FIG. 9. Other structural and operational embodiments will be apparent to persons skilled in the relevant art(s) based on the discussion provided herein. Flowchart 900 is described as follows.

Flowchart 900 begins with step 902. In step 902, a maximum frame energy estimate is determined. The maximum frame energy estimate for an input audio signal may be measured and/or determined according to conventional or other techniques, as would be known to persons skilled in the relevant art(s).

In step 904, a minimum frame energy estimate is determined. The minimum frame energy estimate for an input audio signal may be measure and/or determined according to conventional or other techniques, as would be known to persons skilled in the relevant art(s).

In step 906, a threshold for active signals is determined based on the maximum frame energy estimate and the minimum frame energy estimate. For example, as described above, a first offset may be added to the determined minimum frame energy estimate, and a second offset may be subtracted from the determined maximum frame energy estimate, to generate respective first and second thresholds. The first and/or second thresholds may be compared to an input signal to determine whether the input signal is active.

Figure 10:
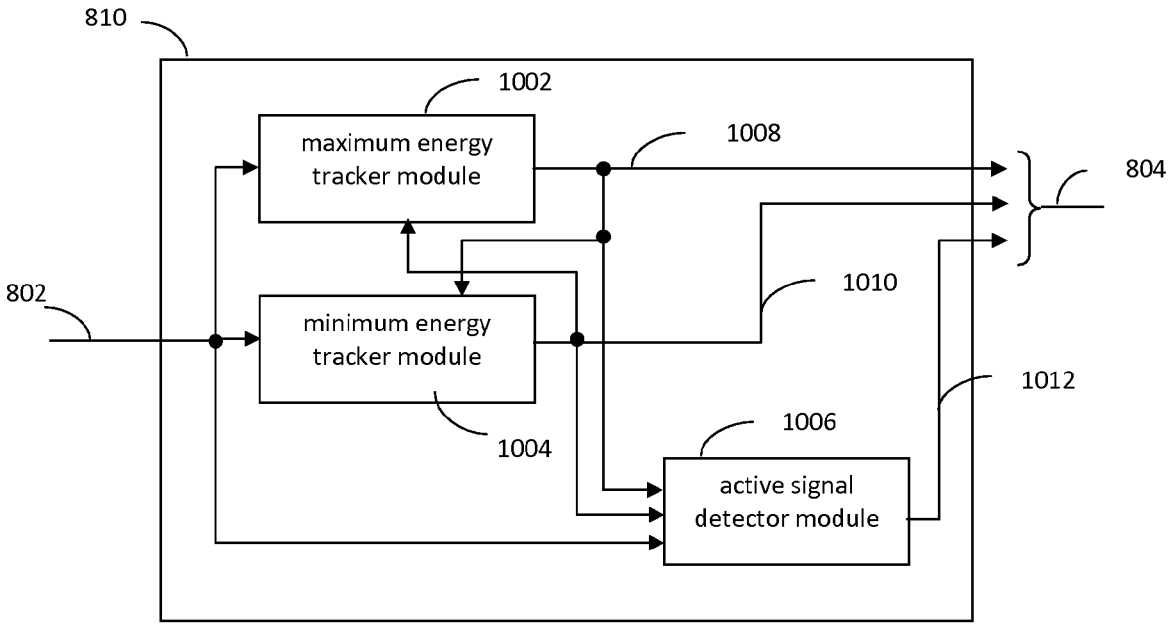
FIG. 10 shows an example block diagram of an energy tracking module, in accordance with an embodiment of the present invention.

FIG. 10 shows an example block diagram of energy tracking module 810, in accordance with an embodiment of the present invention. Energy tracking module 810 shown in FIG. 10 may be used to implement flowchart 900 shown in FIG. 9. However, energy tracking module 810 may also be used in a variety of other applications as will be readily understood by persons skilled in the relevant art(s). As shown in FIG. 10, energy tracking module 810 includes a maximum energy tracker module 1002, a minimum energy tracker module 1004, and an active signal detector module 1006. Example embodiments for these portions of energy tracking module 810 will now be described.

a. Maximum Energy Tracker Module Embodiments

In an embodiment, maximum energy tracker module 1002 generates and maintains a short term estimate (StMaxEst) and a long term estimate (LtMaxEst) of the maximum frame energy for input signal 802. In alternative embodiments, just one of StMaxEst and LtMaxEst may be generated/maintained, and/or other types of estimates may be generated. StMaxEst and LtMaxEst are output by maximum energy tracker module 1002 on maximum energy tracking signal 1008 in a serial, parallel, or other fashion.

In a conventional maximum (or peak) energy tracker, energy of a received signal frame is compared to a current maximum energy estimate. If the current maximum energy estimate is less than the frame energy, the (new) maximum energy estimate is set to the frame energy. If the current maximum energy estimate is greater than the frame energy, the current maximum energy estimate is decreased by a predetermined static amount to create a new maximum energy estimate. This conventional technique results in a maximum energy estimate that jumps to a maximum amount instantaneously and then decays (by the static amount). The static amount for decay is selected as a trade-off between stability (slow decay) and a desired degree of responsiveness, especially if input signal characteristics have changed (e.g., a switch from speech to music or vice versa has occurred; switching from loud, to quiet, to loud, etc., in different sections of a music piece has occurred; or a shift from singing, where there may be many peaks and valleys in the energy profile, to a more instrumental segment that has a more constant energy profile has occurred).

To help overcome the problem of a long term maximum energy estimate that jumps quickly to track a peak energy value, in an embodiment (further described below), LtMaxEst is compared to StMaxEst (which is a relatively quickly decaying average of the frame energy, and thus is a slightly smoothed version of the frame energy), and is then updated, with the resulting LtMaxEst including a running average component and a component based on StMaxEst.

To improve the problem related to decay, in an embodiment (further described below), the decay rate is increased further and further as long as the frame energy is less than StMaxEst. The concept is that longer periods are expected where the frame energy does not reach LtMaxEst, but the frame energy should often cross StMaxEst because StMaxEst decays quickly. If it does not, this is unexpected behavior that is most likely a local or longer term decrease in energy indicating changing characteristics in the signal input. As a result, LtMaxEst is more aggressively decreased. This prevents LtMaxEst from remaining too high for too long when the input signal changes.

It may be desirable to track maximum frame energy in this manner while maintaining similar performance over different input dynamic ranges. For example, if StMaxEst is tracking a signal maximum, and then the signal suddenly goes to the noise floor for a relatively long time period, it is desirable for the decay of StMaxEst to reach the noise floor in approximately the same amount of time whether a relatively high (e.g., 60 dB) dynamic range or a relatively low (e.g., 10 dB) dynamic range was present. Thus, in an embodiment, the adaptation of StMaxEst is normalized to the dynamic range. In an embodiment described further below, StMaxEst is updated based on the current estimated dynamic range of the input signal. In this way, the system becomes adaptive to the dynamic range, where the long term and short term maximum energy estimates adapt slower when receiving small dynamic range signals and adapt faster when receiving wide dynamic range signals.

These embodiments allow for a smooth but responsive long term maximum energy estimate that functions well over a large dynamic range of input signals, and can track changes in dynamic range quickly.

For example, in an embodiment, if the currently measured frame energy, lg, exceeds the currently stored value for StMaxEst, StMaxEst is updated as follows:

$$StMaxEst = StMaxEst \cdot StMaxBeta + lg \cdot (1 - StMaxBeta)$$

where StMaxBeta is a variable set between 0 and 1 (e.g., tuned to 0.5 in one embodiment). StMaxEst may have an initialization value, as appropriate for the particular application. For example, in an embodiment, StMaxEst may have an initial value of 6. The long term maximum estimate, LtMaxEst, is updated as follows:

$$LtMaxEst = LtMaxEst \cdot LtMaxBeta + lg \cdot (1 - LtMaxBeta)$$

where LtMaxBeta is a variable generated to be between 0 and 1. LtMaxEst may have an initialization value, as appropriate for the particular application. For example, in an embodiment, LtMaxEst may have an initial value of 16. After updating LtMaxEst, LtMaxBeta is reset to an initial value (e.g., 0.99 in one embodiment). Furthermore, if StMaxEst is greater than LtMaxEst, LtMaxEst is adjusted as follows:

if (StMaxEst>LtMaxEst)

$$LtMaxEst = LtMaxEst \cdot LtMaxAlpha + StMaxEst \cdot (1 - LtMaxAlpha)$$

where LtMaxAlpha is set between 0 and 1 (e.g., tuned to 0.5 in one embodiment). Thus, as described above, if StMaxEst is greater than LtMaxEst, LtMaxEst is adjusted with the sum of a long term running average component (LtMaxEst LtMaxAlpha) and a component based on StMaxEst (StMaxEst·(1−LtMaxAlpha)). If the frame energy is less than the short term maximum estimate StMaxEst, the more likely the long term maximum estimate LtMaxEst is lagging, so LtMaxBeta may be decreased in order to increase a change in long term maximum estimate LtMaxEst when there is an update:

if (lg≦StMaxEst)

$$LtMaxBeta = LtMaxBeta \cdot LtMaxBetaDecay$$

where $$LtMaxBetaDecay = 0.9998 \cdot \frac{FS}{344} \cdot \frac{16}{SF}$$

and FS is the frame size, and SF is the sampling frequency in kHz.

Finally, the short-term maximum estimate StMaxEst is updated by reducing it slightly, by a factor that depends on the input dynamic range, as mentioned above. As shown in FIG. 10, maximum energy tracker module 1002 receives a minimum energy tracking signal 1010 from minimum energy tracker module 1004. Minimum energy tracking signal 1010 includes a long term minimum energy estimate, LtMinEst, generated by minimum energy tracker module 1004, which is used as an indication of the input dynamic range:

if (StMaxEst>LtMinEst)

$$StMaxEst = StMaxEst - (StMaxEst - LtMinEst) \cdot StMaxStepSize$$

else

StMaxEst=LtMinEst where $$StMaxStepSize = 0.0005 \cdot \frac{FS}{344} \cdot \frac{16}{SF},$$

In this way, the short-term estimate adaptation rate increases with the input dynamic range.

b. Minimum Energy Tracker Module Embodiments

In an embodiment, minimum energy tracker module 1004 generates and maintains a short term estimate (StMinEst) and a long term estimate (LtMinEst) of the minimum frame energy for input signal 802. In alternative embodiments, just one of StMinEst and LtMinEst is generated/maintained, and/or other types of estimates may be generated. StMinEst and LtMinEst are output by minimum energy tracker module 1004 on minimum energy tracking signal 1010 in a serial, parallel, or other fashion.

Similarly to conventional maximum energy trackers described above, conventional minimum energy trackers compare energy of a received signal frame to a current minimum energy estimate. If the current minimum energy estimate is greater than the frame energy, the minimum energy estimate is set to the frame energy. If the current minimum energy estimate is less than the frame energy, the current minimum energy estimate is increased by a predetermined static amount. Again, this conventional technique results in a minimum energy estimate that jumps to a minimum amount instantaneously and then decays upward (by the static amount). To help overcome the problem of a long term minimum energy estimate dropping quickly to track a minimum energy value, in an embodiment (further described below), LtMinEst is compared to StMinEst and is then updated, with the resulting LtMinEst including a running average component and a component based on StMinEst.

Similarly to above, to improve the problem related to decay, in an embodiment (further described below), the decay rate is increased further and further as long as the frame energy is greater than StMinEst. The concept is that longer periods are expected where the frame energy does not reach LtMinEst, but the frame energy should often cross StMinEst because StMinEst decays upward quickly. If it does not, this is unexpected behavior that is most likely a local or longer term increase in energy indicating changing characteristics in the signal input. As a result, LtMinEst is more aggressively increased. This prevents LtMinEst from remaining too low for too long when the input signal changes.

Furthermore, as described above for maximum energy trackers, it may be desirable to track minimum frame energy with similar performance provided over different input dynamic ranges. In an embodiment, the adaptation of StMinEst is normalized to the dynamic range. As described further below, StMinEst is updated based on the current estimated dynamic range of the input signal. In this way, the system becomes adaptive to the dynamic range, where long term and short term minimum energy estimates adapt slower when receiving small dynamic range signals and adapt faster when receiving wide dynamic range signals.

These embodiments allow for a smooth but responsive long term minimum energy estimate that functions well over a large dynamic range of input signals, and can track changes in dynamic range quickly.

For example, in an embodiment, if lg is less than the short term minimum estimate, StMinEst, StMinEst and LtMinEst are updated as follows:

$$StMinEst=StMinEst\cdot StMinBeta+lg\cdot(1-StMinBeta)$$

where StMinBeta is set between 0 and 1 (e.g., tuned to 0.5 in one embodiment). StMinEst may have an initialization value, as appropriate for the particular application. For example, in an embodiment, StMinEst may have an initial value of 21. LtMinEst is updated according to:

$$LtMinEst=LtMinEst\cdot LtMinBeta+lg(1-LtMinBeta)$$

After updating LtMinEst, LtMinBeta is reset to an initial value (e.g., tuned to 0.99 in one embodiment). LtMinEst may have an initialization value, as appropriate for the particular application. For example, in an embodiment, LtMinEst may have an initial value of 6. If the short term min estimate StMinEst is less than the long term estimate LtMinEst, the long term estimate LtMinEst may be adjusted more aggressively, as follows:

if (StMinEst<LtMinEst)

$$LtMinEst=LtMinEst\cdot LtMinAlpha+StMinEst\cdot(1-LtMinAlpha)$$

where LtMinAlpha is set between 0 and 1 (e.g., tuned to 0.5 in one embodiment). Thus, as described above, if StMinEst is less than LtMinEst, LtMinEst is adjusted with the sum of a long term running average component (LtMinEst·LtMinAlpha) and a component based on StMinEst (StMinEst·(1−LtMinAlpha)).

However, if the frame energy is not less than the short term minimum estimate StMinEst, the more likely that the long term min estimate LtMinEst is lagging. In this case, LtMinBeta is decreased in order to increase a change to LtMinEst when there is an update:

$$LtMinBeta=LtMinBeta\cdot LtMinBetaDecay$$

where $$LtMinBetaDecay = 0.9998\cdot\frac{FS}{344}\cdot\frac{16}{SF}$$

As described above, the short term minimum estimate StMinEst is then updated by increasing it slightly by a factor that depends on the dynamic range of input signal 802. As shown in FIG. 10, minimum energy tracker module 1004 receives maximum energy tracking signal 1008 from maximum energy tracker module 1002. Maximum energy tracking signal 1008 includes long term maximum energy estimate, LtMaxEst, generated by maximum energy tracker module 1002, which is used as an indication of the input dynamic range:

if (StMinEst<LtMaxEst)

$$StMinEst=StMinEst+(LtMaxEst-StMinEst)\cdot StMinStepSize$$

else

StMinEst=LtMaxEst where $$StMinStepSize = 0.0005\cdot\frac{FS}{344}\cdot\frac{16}{SF}$$

Finally, if either the short term minimum estimate StMinEst or long term minimum estimate LtMinEst is below a minimum threshold (e.g., set to −1 in one embodiment), they are set to that threshold.

c. Active Signal Detector Module Embodiments

As shown in FIG. 10, active signal detector module 1006 receives input signal 802, maximum energy tracking signal 1008 and minimum energy tracking signal 1010. Active signal detector module 1006 generates a threshold, ThActive, which may be used to indicate an active signal for input signal 802. ThActive may be generated according to:

$$ThMax=LtMaxEst-4.5$$

$$ThMin=LtMinEst+5.5$$

$$ThActive=\max(\min(ThMax,ThMin),11.0)$$

In alternative embodiments, values other than 4.5, 5.5, and/or 11.0 may be used to generate ThActive, depending on the particular application. Active signal detector module 1006 may further perform a comparison of energy of the current frame, lg, to ThActive, to determine whether input signal 802 is currently active:

```
if (lg > ThActive)
    ActiveSignal = TRUE
else
    ActiveSignal = FALSE
```

If ActiveSignal is TRUE, then input signal 802 is currently active. If ActiveSignal is FALSE, then input signal 802 is not active. Active signal detector module 1006 outputs ActiveSignal on active signal indicator signal 1012. Energy tracker module 810 outputs maximum energy tracking signal 1008, minimum energy tracking signal 1010, and active signal indicator signal 1008 in a serial, parallel, or other fashion on energy tracking signal 804.

2. Feature Extraction Module Embodiments

As shown in FIG. 8, feature extraction module 820 receives input audio signal 802. Feature extraction module 820 analyzes one or more features of the input audio signal 802. The analyzed features may be used by classifier 800 to determine whether the audio signal is a speech or non-speech (e.g., music, general audio, noise) signal. Thus, the features typically discriminate in some manner between speech and non-speech, and/or between unvoiced speech and voiced speech. In embodiments, any number and type of suitable features of input signal 802 may be analyzed by feature extraction module 820. It is noted that feature extraction module 820 may alternatively be used in other applications as will be readily understood by persons skilled in the relevant art(s).

Figure 11:
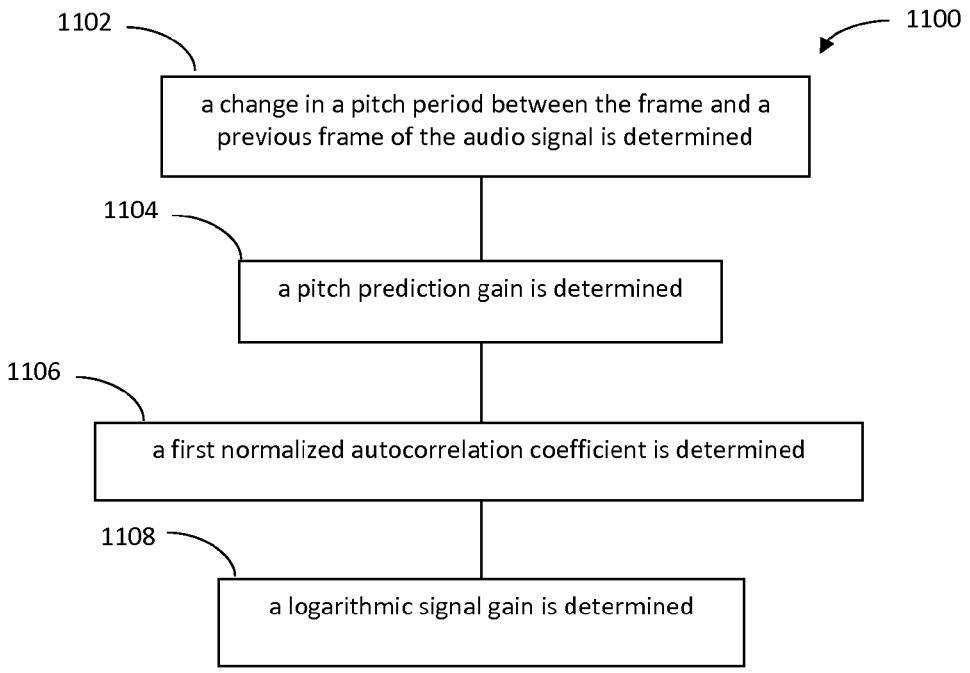
FIG. 11 shows a flowchart providing example steps for analyzing features of an audio signal, according to embodiments of the present invention.

FIG. 11 shows a flowchart 1100 providing example steps for analyzing features of an audio signal, according to example embodiments of the present invention. Flowchart 1100 may be performed by feature extraction module 820. The steps of flowchart 1100 need not necessarily occur in the order shown in FIG. 11. Furthermore, in embodiments, not all steps of flowchart 1100 are necessarily performed. For example, flowchart 1100 relates to the analysis of four features of an audio signal. In alternative embodiments, fewer, additional, and/or alternative features of the audio signal may be analyzed. Other structural and operational embodiments will be apparent to persons skilled in the relevant art(s) based on the discussion provided herein.

Figure 12:
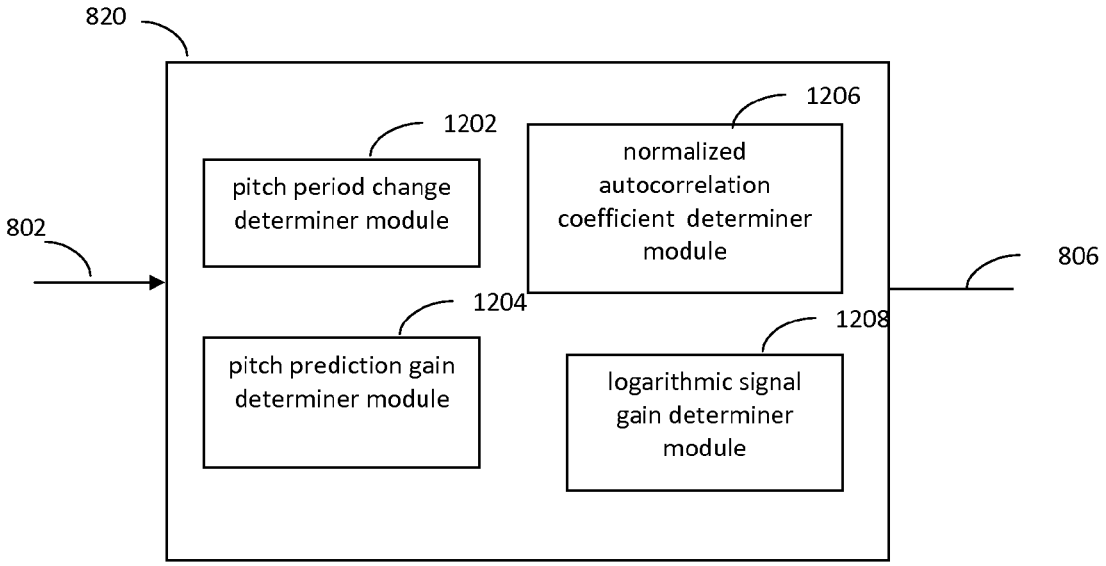
FIG. 12 shows an example block diagram of an audio signal feature extraction module, in accordance with an embodiment of the present invention.

Flowchart 1100 is described as follows with respect to FIG. 12. FIG. 12 shows an example block diagram of feature extraction module 820, in accordance with an example embodiment of the present invention. As shown in FIG. 12, feature extraction module 820 includes a pitch period change determiner module 1202, a pitch prediction gain determiner module 1204, a normalized autocorrelation coefficient determiner module 1206, and a logarithmic signal gain determiner module 1208. These modules of feature extraction module 820 are further described below along with a corresponding step of flowchart 1100.

In step 1102 of flowchart 1100, a change in a pitch period between the frame and a previous frame of the audio signal is determined. Pitch period change determiner module 1202 may perform step 1102. Pitch period change determiner module 1202 analyzes a first signal feature, which is a fractional change in pitch period, $pp_\Delta$, from one signal frame to the next. In an embodiment, the change in pitch period is calculated by pitch period change determiner module 1202 according to:

$$pp_\Delta = \frac{|pp_i - pp_{i-1}|}{pp_i}$$

where:

$pp_i$=a pitch period of a current input signal frame; and $pp_{i-1}$=a pitch period of a previous input signal frame.

In step 1104, a pitch prediction gain is determined. For example, pitch prediction gain determiner module 1204 may perform step 1104. Pitch prediction gain determiner module 1204 analyzes a second signal feature, which is pitch prediction gain, ppg. In an embodiment, pitch prediction gain is calculated by pitch prediction gain determiner module 1204 according to:

$$ppg = 10 \cdot \log_{10}\left(\frac{E}{R}\right),$$

where:

E=the signal energy in the pitch analysis window; and

R=the pitch prediction residual energy.

E may be calculated by:

$$E = \sum_{n=N-K+1}^{N} x^2(n),$$

where:

K=the analysis window size.

R may be calculated by:

$$R = E - \frac{c^2(pp_i)}{\sum_{n=N-K+1}^{N} x^2(n - pp_i)},$$

where:

c(·)=the signal correlation, which may be calculated by:

$$c(j) = \sum_{n=N-K+1}^{N} x(n) \cdot x(n-j).$$

In step 1106, a first normalized autocorrelation coefficient is determined. For example, normalized autocorrelation coefficient determiner module 1206 may perform step 1106. Normalized autocorrelation coefficient determiner module 1206 analyzes a third signal feature, which is the first normalized autocorrelation coefficient, $\rho_1$. In an embodiment, the first normalized autocorrelation coefficient is calculated by normalized autocorrelation coefficient determiner module 1206 according to:

$$\rho_1 = \frac{\sum_{n=N-K+2}^{N} x(n) \cdot x(n-1)}{E}$$

Note that $\rho_1$ works well for narrowband signals (up to 16 kHz). Beyond the narrowband signal range, $\rho_{[SF/16]}$ may instead be desirable to use, where SF is the sampling frequency in kHz.

In step 1108, a logarithmic signal gain is determined. For example, logarithmic signal gain determiner module 1208 may perform step 1108. Logarithmic signal gain determiner module 1208 analyzes a fourth signal feature, which is the logarithmic signal gain, lg. In an embodiment, the logarithmic signal gain is calculated by logarithmic signal gain determiner module 1208 according to:

$$lg = \log_2(E/K).$$

As shown in FIG. 12, feature extraction module 820 outputs an extracted feature signal 806, which includes the results of the analysis of the one or more analyzed signal features, such as change in pitch period, PP A (from module 1202), pitch prediction gain, ppg (from module 1204), first normalized autocorrelation coefficient, $\rho_1$ (from module 1206), and logarithmic signal gain, lg (from module 1208).

3. Normalization Module Embodiments

As shown in FIG. 8, normalization module 830 receives energy tracking signal 804 and extracted feature signal 806. Normalization module 830 normalizes the analyzed signal feature results received on extracted feature signal 806. In embodiments, normalization module 830 may normalize results for any number and type of received features, as desired for the particular application. In an embodiment, normalization module 830 is configured to normalize the feature results such that the normalized feature results tend in a first direction (e.g., toward −1) for unvoiced or noise-like characteristics and in a second direction (e.g., toward +1) for voiced speech or a signal that is periodic.

In embodiments, signal features are normalized by normalization module 830 to be between a lower bound value and a higher bound value. For example, in an embodiment, each signal feature is normalized between −1 and +1, where a value near −1 is an indication that input signal 802 has unvoiced or noise-like characteristics, and a value near +1 indicates that input signal 802 likely includes voiced speech or a signal that is periodic.

It should be noted that the normalization techniques provided below are just example ways of performing normalization. They are all basically clipped linear functions. Other normalization techniques may be used in alternative embodiments. For example, one could derive more complicated smooth higher order functions that would approach −1,+1.

Figure 13:
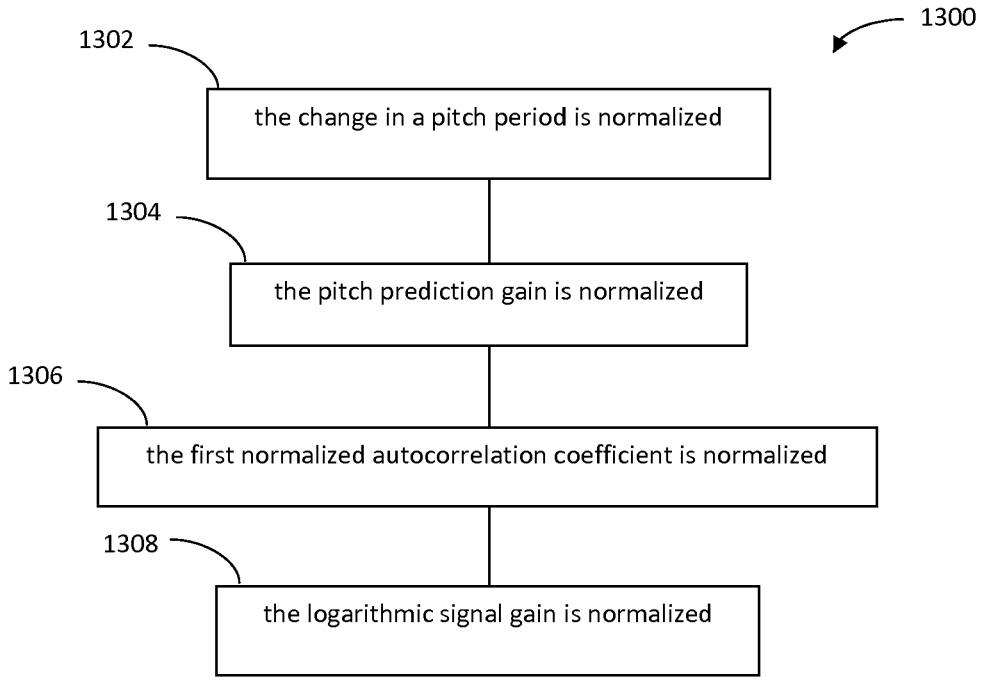
FIG. 13 shows a flowchart providing example steps for normalizing audio signal features, according to embodiments of the present invention.

FIG. 13 shows a flowchart 1300 providing example steps for normalizing signal features, according to example embodiments of the present invention. Flowchart 1300 may be performed by normalization module 830. The steps of flowchart 1300 need not necessarily occur in the order shown in FIG. 13. Furthermore, in embodiments, not all steps of flowchart 1300 are necessarily performed. For example, flowchart 1300 relates to the normalization of four features of an audio signal. In alternative embodiments, fewer, additional, and/or alternative features of the audio signal may be normalized. Other structural and operational embodiments will be apparent to persons skilled in the relevant art(s) based on the discussion provided herein.

Figure 14:
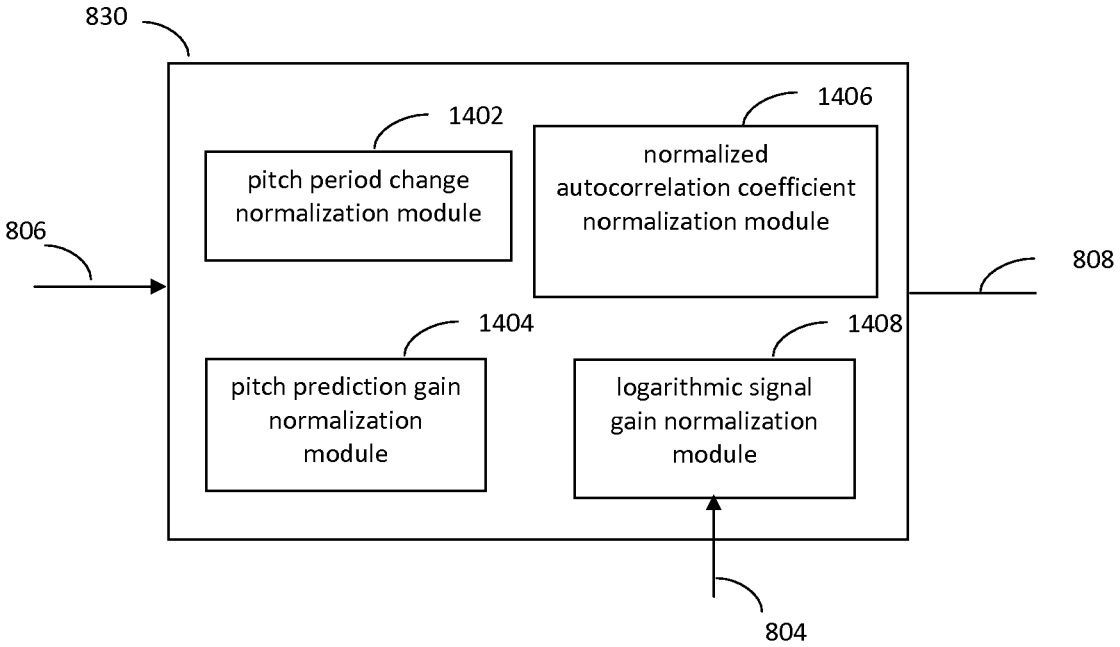
FIG. 14 shows an example block diagram of a normalization module, in accordance with an embodiment of the present invention.

Flowchart 1300 is described as follows with respect to FIG. 14. FIG. 14 shows an example block diagram of normalization module 830, in accordance with an example embodiment of the present invention. As shown in FIG. 14, normalization module 830 includes a pitch period change normalization module 1402, a pitch prediction gain normalization module 1404, a normalized autocorrelation coefficient normalization module 1406, and a logarithmic signal gain normalization module 1408. These modules of normalization module 830 are further described below along with a corresponding step of flowchart 1300.

a. Delta Pitch

In step 1302 of flowchart 1300, the change in a pitch period is normalized. Pitch period change normalization module 1402 may perform step 1302. Pitch period change normalization module 1402 receives change in pitch period, $pp_\Delta$, on extracted feature signal 806, and outputs a normalized pitch period change, $N_pp_\Delta$, on a normalized feature signal 808.

During voiced speech, the pitch changes very slowly from one frame (approx 20 ms frames) to the next, and so $pp_\Delta$ should tend to be small. During unvoiced speech, the detected pitch is essentially random, and so $pp_\Delta$ should tend to be large. An example pitch period change normalization that may be performed by module 1402 in an embodiment is given by:

$$N_pp_\Delta=(1-\min(3\cdot pp_\Delta,1))\cdot 2-1$$

In other embodiments, other equations for normalizing pitch period change may alternatively be used.

b. Pitch Prediction Gain

In step 1304, the pitch prediction gain is normalized. For example, pitch prediction gain normalization module 1404 may perform step 1304. Pitch prediction gain normalization module 1404 receives pitch prediction gain, ppg, on extracted feature signal 806, and outputs a normalized pitch prediction gain, N_ppg, on normalized feature signal 808.

During voiced speech, the pitch prediction gain, ppg, will tend to be high, indicating periodicity at the pitch lag. However, during unvoiced speech, there is no periodicity at the pitch lag, and ppg will tend to be low. An example pitch prediction gain normalization that may be performed by module 1404 in an embodiment is given by:

$$\text{N_ppg} = \frac{\max(\min(ppg, 10), 0)}{5} - 1$$

In other embodiments, other equations for normalizing pitch prediction gain may alternatively be used.

c. First Normalized Autocorrelation Coefficient

In step 1306, the first normalized autocorrelation coefficient is normalized. For example, normalized autocorrelation coefficient normalization module 1406 may perform step 1306. Normalized autocorrelation coefficient normalization module 1406 receives first normalized autocorrelation coefficient, $\rho_1$, on extracted feature signal 806, and outputs a normalized first normalized autocorrelation coefficient, $N_\rho_1$ on normalized feature signal 808.

During voiced speech, the first normalized autocorrelation coefficient, $\rho_1$, will tend to be close to +1, whereas for unvoiced speech, $\rho_1$ will tend to be much less than 1. An example first normalized autocorrelation coefficient normalization that may be performed by module 1406 in an embodiment is given by:

$$N_\rho_1=\max(\rho_1,0)\cdot 2-1$$

In other embodiments, other equations for normalizing the first normalized autocorrelation coefficient may alternatively be used.

d. Logarithmic Signal Gain

In step 1308, the logarithmic signal gain is normalized. For example, logarithmic signal gain normalization module 1408 may perform step 1308. Logarithmic signal gain coefficient normalization module 1408 receives logarithmic signal gain, lg, on extracted feature signal 806, and outputs a normalized logarithmic signal gain, N_lg, on normalized feature signal 808.

During voiced speech, the logarithmic signal gain, lg, will tend to be high, while during unvoiced speech it will tend to be low. As shown in FIG. 14, in an embodiment, logarithmic signal gain normalization module 1408 receives energy tracking signal 804. LtMaxEst, LtMinEst, and ThActive provided on energy tracking signal 804 are used to normalize the logarithmic signal gain. An example logarithmic signal gain normalization that may be performed by module 1408 in an embodiment is given by:

if((LtMaxEst − LtMinEst) > 6) & (lg > ThActive)

$$\text{N_lg} = \max\left(\min\left(\frac{\text{lg} - (\text{LtMaxEst} - 10)}{5} - 1, 1\right), -1\right)$$

else $$\text{N_lg} = 0$$

In other embodiments, other equations for normalizing logarithmic signal gain may alternatively be used.

4. Speech Likelihood Measure Module Embodiments

As shown in FIG. 8, speech likelihood measure module 840 receives normalized feature signal 808. Speech likelihood measure module 840 makes a determination whether speech is likely to have been received on input signal 802, by calculating one or more speech likelihood measures.

In an embodiment, a single speech likelihood measure, SLM, is calculated by module 840 by combining the normalized features received on normalized feature signal 808, as follows:

$$SLM=N_pp_\Delta+N_ppg+N_\rho_1+N_lg.$$

In an embodiment, where each normalized feature is in a range (−1 to +1), SLM is in the range {−4 to +4}. Values close to the minimum or maximum values of the range indicate a likelihood that speech is present in input signal 802, while values close to zero indicate the likelihood of the presence of music or other non-speech signals.

Note that in alternative embodiments, SLM may have a range other than {−4 to +4}. For example, one or more normalized features in the equation for SLM above may have ranges other than (−1 to +1). Additionally, or alternatively, one or more normalized features in the equation for SLM may be multiplied, divided, or otherwise scaled by a weighting factor, to provide the one or more normalized features with a weight in SLM that is different from one or more of the other normalized features. Such variation in ranges and/or weighting may be used to increase or decrease the importance of one or more of the normalized features in the speech likelihood determination, for example.

In an embodiment, a number and type of the features are selected to have little or no correlation between normalized features in tending toward the first value or the second value for a typical music audio signal. Enough features are selected such that this random direction tends to cancel the sum SLM when adding the normalized results to generally yield a sum near zero. The normalized features themselves may also generally be close to zero for certain music. For example, in multiple instrument music, a single pitch will give a pitch prediction gain that is low since the single pitch can only track one instrument and the prediction does not necessarily capture the energy in the other instrument (assuming the other instruments are at a different pitch).

As shown in FIG. 8, speech likelihood measure module 840 outputs speech likelihood indicator signal 812, which includes SLM.

5. Long Term Running Average Module Embodiments

As shown in FIG. 8, long term running average module 850 receives speech likelihood indicator signal 812 and energy tracking signal 804. Long term running average module 850 generates a running average of speech likelihood indicator signal 812.

In an embodiment, a long term speech likelihood running average, LTSLM, is generated by module 850 according to the equation:

if (lg>ThActive)

$$LTSLM=LTSLM*Ltsl\text{Alpha}+|SLM|*(1-Ltsl\text{Alpha})$$

where LtslAlpha is a variable that may be set between 0 and 1 (e.g., tuned to 0.99 in one embodiment). As indicated above, in an embodiment, the long term average is updated by module 850 only when an active signal is indicated by ThActive on energy tracking signal 804. This provides classification robustness during background noise.

As shown in FIG. 8, long term running average module 850 outputs long term running average signal 814, which includes LTSLM.

6. Classification Module Embodiments

As shown in FIG. 8, classification module 860 receives long term running average signal 814. Classification module 860 classifies the current frame of input signal 802 as speech or non-speech.

For example, in an embodiment, the classification, Class (i), for the ith frame is calculated by module 860 according to the equation:

```
if (Class(i−1) == SPEECH)
   if (LTSLM > 1.75)
      Class(i) = SPEECH
   else
      Class(i) = NONSPEECH
else
   if (LTSLM > 1.85)
      Class(i) = SPEECH
   else
      Class(i) = NONSPEECH
```

where Class(i−1) is the classification of the prior (i−1) classified frame of input signal 802. Threshold values other than 1.75 and 1.85 may alternatively be used by module 860, in other embodiments.

As shown in FIG. 8, classification module 860 outputs classification signal 818, which includes Class(i). Classification signal 818 is received by FLC/decision control logic 140, shown in FIG. 1.

7. Example Classifier Process Embodiments

Figure 15:
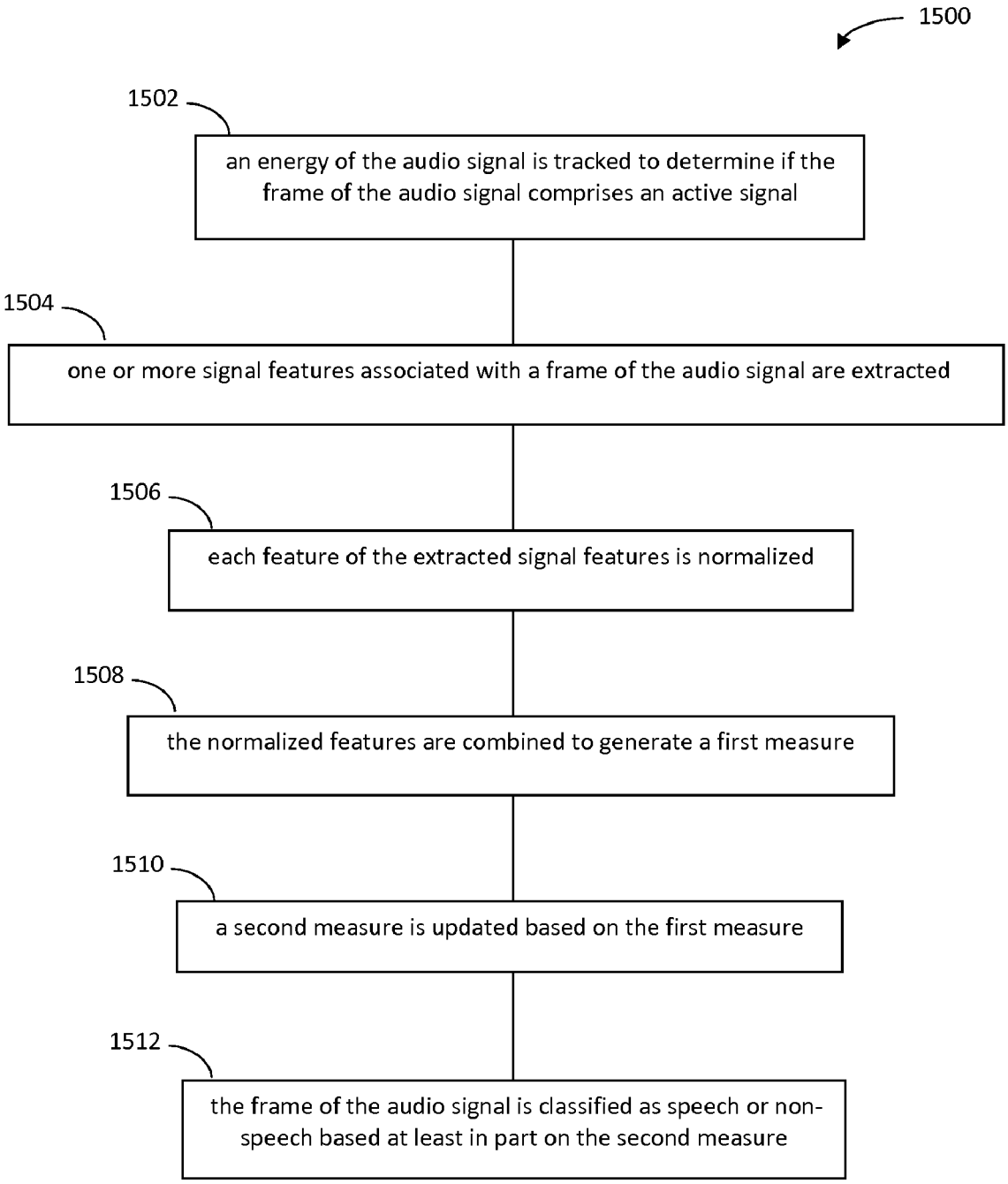
FIG. 15 shows a flowchart providing example steps for classifying audio signals as speech or music, according to embodiments of the present invention.

FIG. 15 shows a flowchart 1500 providing example steps for classifying audio signals as speech or music, according to example embodiments of the present invention. Flowchart 1500 may be performed by signal classifier 130 described above with regard to FIG. 1, for example. The steps of flowchart 1500 need not necessarily occur in the order shown in FIG. 15. Other structural and operational embodiments will be apparent to persons skilled in the relevant art(s) based on the discussion provided herein. Flowchart 1500 is described as follows.

Flowchart 1500 begins with step 1502. In step 1502, an energy of the audio signal is tracked to determine if the frame of the audio signal comprises an active signal. For example, in an embodiment, energy tracker module 810 performs step 1502. Furthermore, the steps of flowchart 900 shown in FIG. 9 may be performed during step 1502.

In step 1504, one or more signal features associated with a frame of the audio signal are extracted. For example, in an embodiment, feature extraction module 820 performs step 1504. Furthermore, the steps of flowchart 1100 shown in FIG. 11 may be performed during step 1504.

In step 1506, each feature of the extracted signal features is normalized. For example, in an embodiment, normalization module 830 performs step 1506. Furthermore, the steps of flowchart 1300 shown in FIG. 13 may be performed during step 1506.

In step 1508, the normalized features are combined to generate a first measure. For example, in an embodiment, speech likelihood measure module 840 performs step 1508. In an embodiment, the first measure is the speech likelihood measure, SLM.

In step 1510, a second measure is updated based on the first measure. In an embodiment, the second measure comprises a long-term running average of the first measure. For example, in an embodiment, long term running average module 850 performs step 1510. In an embodiment, the second measure is the long term speech likelihood running average, LTSLM. In an embodiment, step 1510 is performed only if the frame of the audio signal comprises an active signal, as determined by step 1502.

In step 1512, the frame of the audio signal is classified as speech or non-speech based at least in part on the second measure. For example, in an embodiment, classification module 860 performs step 1512.

C. Scaled Window Overlap Add for Mixed Signals in Accordance with an Embodiment of the Present Invention An embodiment of the present invention uses a dynamic mix of windows to overlap two signals whose normalized cross-correlation may vary from zero to one. If the overlapping signals are decomposed into a correlated component and an uncorrelated component, they are overlap-added separately using the appropriate window, and then added together. If the overlapping signals are not decomposed, a weighted mix of windows is used. The mix is determined by a measure estimating the amount of cross-correlation between overlapping signals, or the relative amount of correlated to uncorrelated signals.

The following methods are used to perform certain overlap-add operations as described above in Section A in the context of frame loss concealment. For example, in embodiments, the following techniques may be used in step 212 of flowchart 200 in FIG. 2 and step 512 of flowchart 500 in FIG. 5. However, embodiments are not limited to those applications. The example embodiments described herein are provided for illustrative purposes, and are not limiting. Further structural and operational embodiments, including modifications/alterations, will become apparent to persons skilled in the relevant art(s) from the teachings herein.

Two signals to be overlapped added may be defined as a first signal segment that is to be faded out, and a second signal segment that is to be faded in. For example, the first signal segment may be a first received segment of an audio signal, and the second signal segment may be a second received segment of the audio signal.

A general overlap-add of the two signals can be defined by:

$$s(n)=s_{out}(n)\cdot w_{out}(n)+s_{in}(n)\cdot w_{in}(n)\ n=0\ldots N-1$$

where $s_{out}$ is the signal to be faded out, $s_{in}$ is the signal to be faded in, $w_{out}$ is a fade-out window, $w_{in}$ is the fade-in window, and N is the overlap-add window length.

Let the overlap-add window for correlated signals be denoted wc and have the property:

$$wc_{out}(n)+wc_{in}(n)=1\ n=0\ldots N-1$$

Let the overlap-add window for uncorrelated signals be denoted wu and have the property:

$$wc_{out}(n)+wc_{in}(n)=1\ n=0\ldots N-1$$

1. First Embodiment

Overlapping Decomposed Signals with Decomposed Signals

In this embodiment, the signals for overlapping are decomposed into a correlated component, $sc_{out}$ and $sc_{in}$, and an uncorrelated component, $su_{out}$ and $su_{in}$. The overlapped signal s(n) is then given by the following equation (Equation C.1):

$$s(n)=[sc_{out}(n)\cdot wc_{out}(n)+sc_{in}(n)\cdot wc_{in}(n)]+n=0\ldots N-1$$

$$[su_{out}(n)\cdot wu_{out}(n)+su_{in}(n)\cdot wu_{in}(n)]$$

Figure 16:
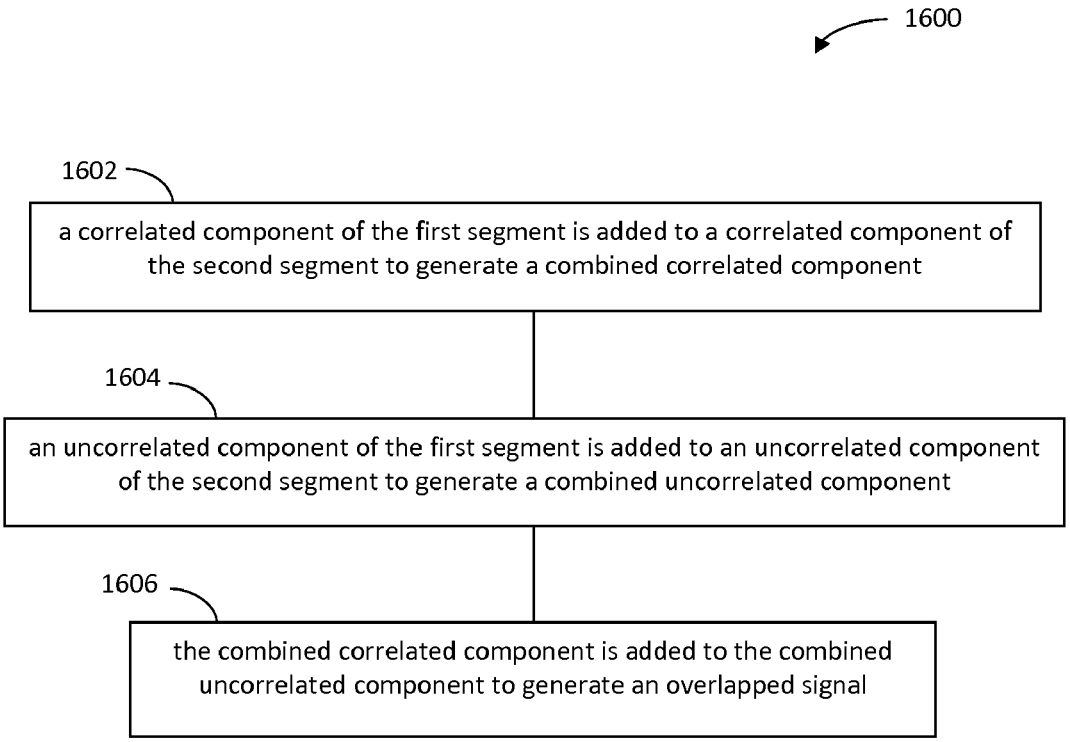
FIG. 16 shows a flowchart providing example steps for overlapping first and second decomposed signals, according to embodiments of the present invention.
Figure 17:
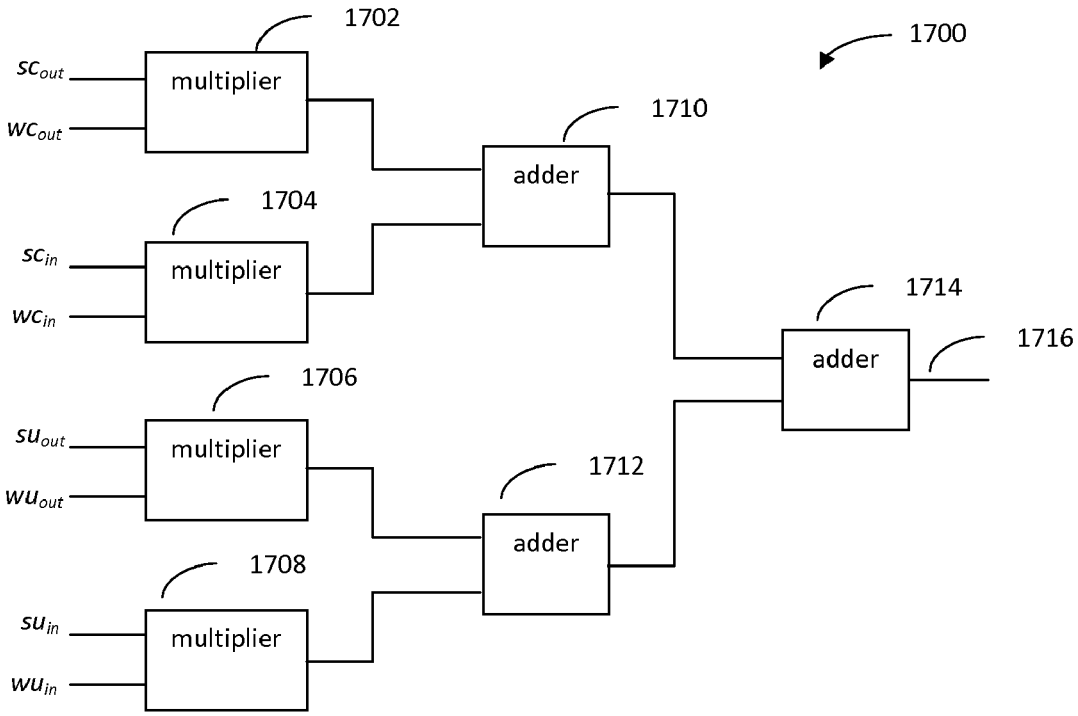
FIG. 17 shows a system configured to overlap first and second decomposed signals, according to an example embodiment of the present invention.

FIG. 16 shows a flowchart 1600 providing example steps for overlapping a first decomposed signal with a second decomposed signal according to the above Equation C.1. The steps of flowchart 1600 need not necessarily occur in the order shown in FIG. 16. Other structural and operational embodiments will be apparent to persons skilled in the relevant art(s) based on the discussion provided herein. For example, FIG. 17 shows a system 1700 configured to implement Equation C.1, according to an embodiment of the present invention. Flowchart 1600 is described as follows with respect to FIG. 17, for illustrative purposes.

Flowchart 1600 begins with step 1602. In step 1602, a correlated component of the first segment is added to a correlated component of the second segment to generate a combined correlated component. For example, as shown in FIG. 17, the correlated component of the first segment, $sc_{out}$, is multiplied with a correlated fade-out window, $wc_{out}$, by a first multiplier 1702, to generate a first product. The correlated component of the second segment, $sc_{in}$, is multiplied with a correlated fade-in window, $wc_{in}$, by a second multiplier 1704, to generate a second product. The first product is added to the second product by a first adder 1710 to generate the combined correlated component, $sc_{out}(n)\,wc_{out}(n)+sc_{in}(n)\cdot wc_{in}(n)$.

In step 1604, an uncorrelated component of the first segment is added to an uncorrelated component of the second segment to generate a combined uncorrelated component. For example, as shown in FIG. 17, the uncorrelated component of the first segment, $su_{out}$, is multiplied with an uncorrelated fade-out window, $wu_{out}$, by third multiplier 1706, to generate a first product. The uncorrelated component of the second segment, $su_{in}$, is multiplied with an uncorrelated fade-in window, $wu_{in}$, by fourth multiplier 1708, to generate a second product. The first product is added to the second product by a second adder 1712 to generate the combined uncorrelated component $su_{out}(n)\cdot wu_{out}(n)+su_{in}(n)\cdot wu_{in}(n)$.

In step 1606, the combined correlated component is added to the combined uncorrelated component to generate an overlapped signal. For example, as shown in FIG. 17, the combined correlated component is added to the combined uncorrelated component by third adder 1714, to generate the overlapped signal, shown as signal 1716.

Note that first through fourth multipliers 1702, 1704, 1706, and 1708, and first through third adders 1710, 1712, and 1714, and further multipliers and adders described in Section C., may be implemented in hardware, software, firmware, or any combination thereof, including respectively as sequence multipliers and adders that are well known to persons skilled in the relevant art(s). For example, such multipliers and adders may be implemented in logic, such as a programmable logic chip (PLC), in a programmable gate array (PGA), in a digital signal processor (DSP), as software instructions that execute in a processor, etc.

2. Second Embodiment

Overlapping a Mixed Signal with a Decomposed Signal

In this embodiment, one of the overlapping signals (in or out) is decomposed while the other signal has the correlated and uncorrelated components mixed together. Ideally, the mixed signal is first decomposed and the first embodiment described above is used. However, signal decomposition is very complex and overkill for most applications. Instead, the optimal overlapped signal may be approximated by the following equation (Equation C.2.a):

$$s(n)=[s_{out}(n)\cdot wc_{out}(n)]\cdot\beta+sc_{in}(n)\cdot wc_{in}(n)+n=0\ldots N-1$$

$$[s_{out}(n)\cdot wu_{out}(n)]\cdot(1-\beta)+su_{in}(n)\cdot wu_{in}(n)$$

where β is the desired fraction of correlated signal in the final overlapped signal s(n), or an estimate of the cross-correlation between $s_{out}$ and $sc_{in}+su_{in}$. The above formulation is given for a mixed $s_{out}$ signal and decomposed $s_{in}$ signal. A similar formulation for the opposite case, where $s_{out}$ is decomposed and Sin is mixed, is provided by the following equation (Equation C.2.b):

$$s(n)=sc_{out}(n)\cdot wc_{out}(n)+[s_{in}(n)\cdot wc_{in}(n)]\cdot\beta+n=0\ldots N-1$$

$$su_{out}(n)\cdot wu_{out}(n)+[s_{in}(n)\cdot wu_{in}(n)]\cdot(1-\beta)$$

Notice that for both formulations, if the signals are completely correlated (β=1) or completely uncorrelated (β=0), each solution is optimal.

Figure 18:
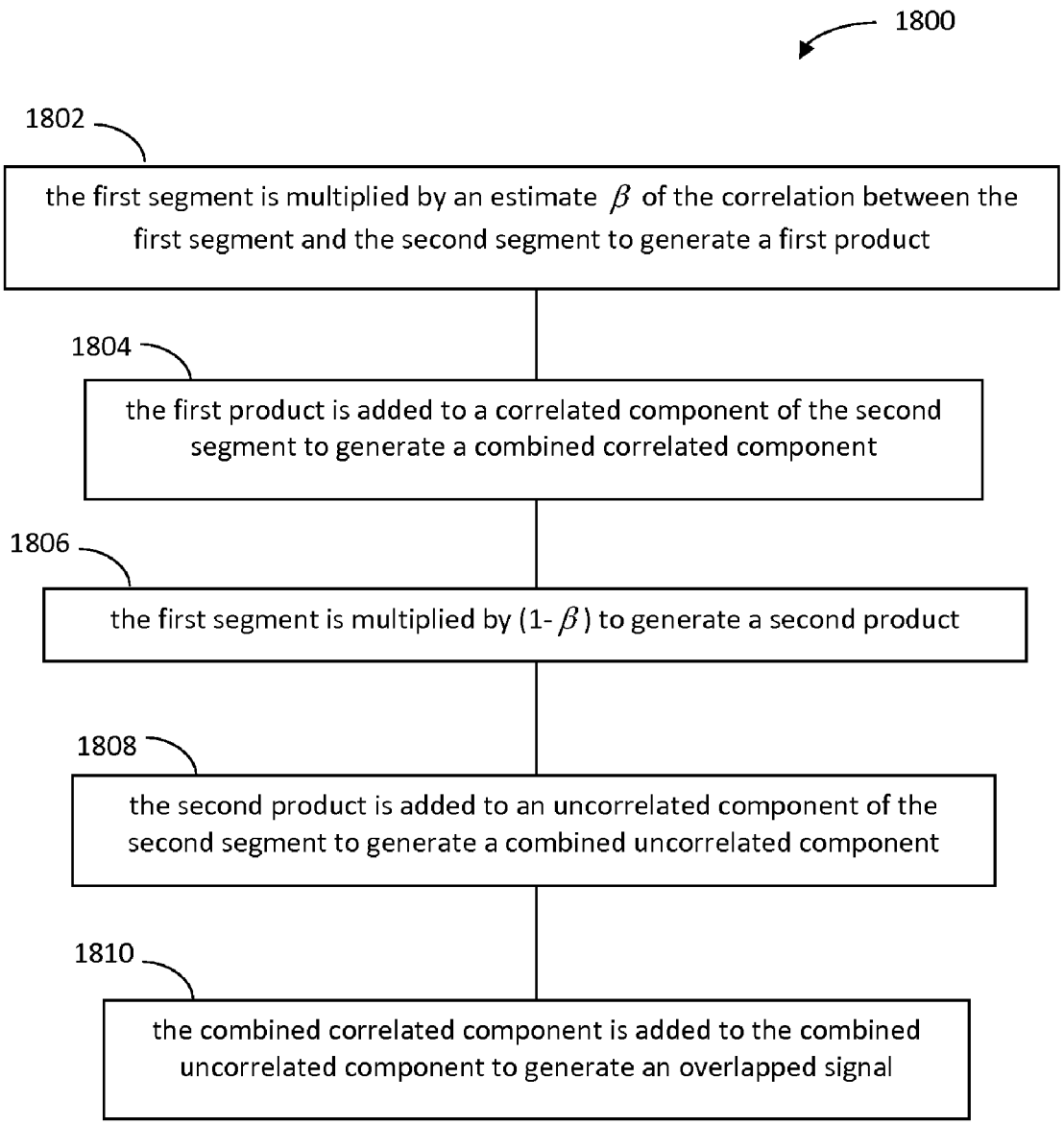
FIG. 18 shows a flowchart providing example steps for overlapping a decomposed signal with a non-decomposed signal, according to embodiments of the present invention.
Figure 19:
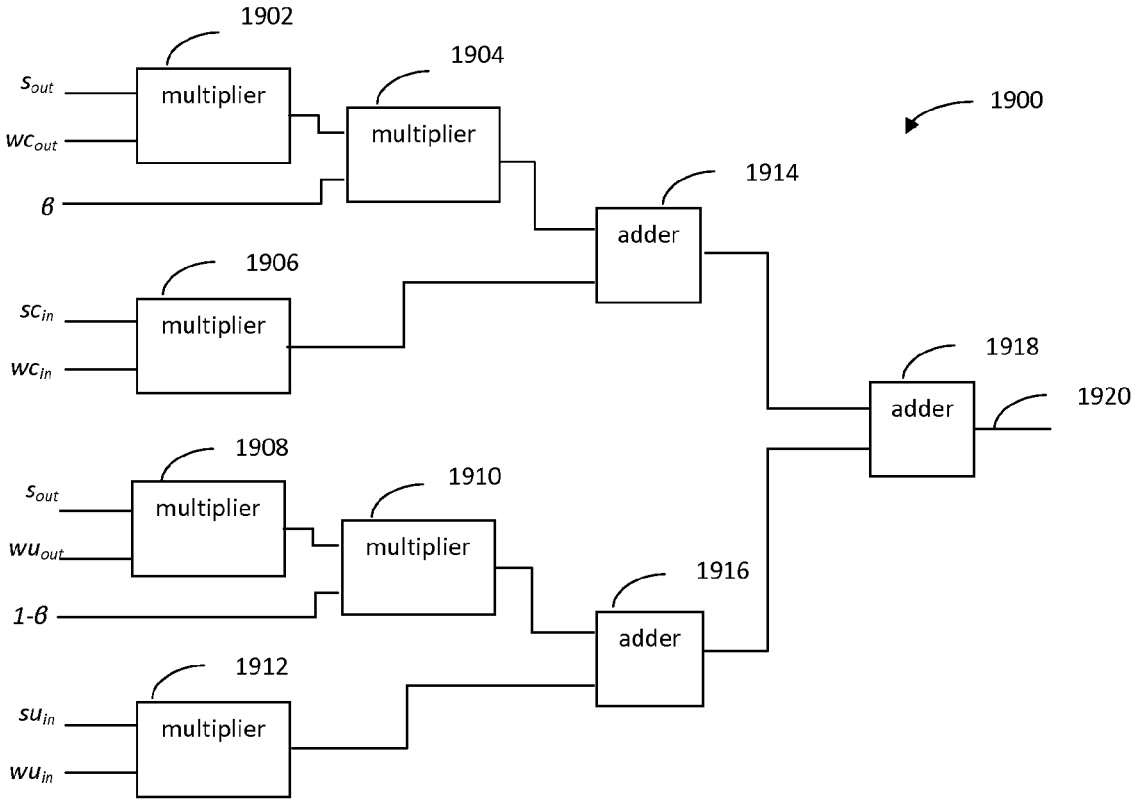
FIG. 19 shows a system configured to overlap a decomposed signal with a non-decomposed signal, according to an example embodiment of the present invention.

FIG. 18 shows a flowchart 1800 providing example steps for overlapping a first signal with a second signal according to the above equation. The steps of flowchart 1800 need not necessarily occur in the order shown in FIG. 18. Other structural and operational embodiments will be apparent to persons skilled in the relevant art(s) based on the discussion provided herein. For example, FIG. 19 shows a system 1900 configured to implement the above Equation C.2.a, according to an embodiment of the present invention. It is noted that it will be apparent to persons skilled in the relevant art(s) how to reconfigure system 1900 to implement Equation C.2.b provided above. Flowchart 1800 is described as follows with respect to FIG. 19, for illustrative purposes.

Flowchart 1800 begins with step 1802. In step 1802, the first segment is multiplied by an estimate β of the correlation between the first segment and the second segment to generate a first product. For example, as shown in FIG. 19, the first segment, $s_{out}$, is multiplied with a correlated fade-out window, $wc_{out}$, by a first multiplier 1902, to generate a third product, $s_{out}(n)\cdot wc_{out}(n)$. The third product is multiplied with β by a second multiplier 1904 to generate the first product.

In step 1804, the first product is added to a correlated component of the second segment to generate a combined correlated component. For example, as shown in FIG. 19, the correlated component of the second segment, $sc_{in}(n)$, is multiplied with a correlated fade-in window, $wc_{in}(n)$, by a third multiplier 1906, to generate a fourth product, $sc_{in}(n)\ wc_{in}(n)$. The first product is added to the fourth product by a first adder 1914 to generate the combined correlated component.

In step 1806, the first segment is multiplied by (1−β) to generate a second product. For example, the first segment, $s_{out}$, is multiplied with an uncorrelated fade-out window, $wu_{out}(n)$, by a fourth multiplier 1908, to generate a fifth product, $s_{out}(n)\cdot wu_{out}(n)$. The fifth product is multiplied with (1−β) by a fifth multiplier 1910 to generate the second product.

In step 1808, the second product is added to an uncorrelated component of the second segment to generate a combined uncorrelated component. For example, the uncorrelated component of the second segment, $su_{in}(n)$, is multiplied with an uncorrelated fade-in window, $wu_{in}(n)$, by a sixth multiplier 1912, to generate a sixth product, $su_{in}(n)\cdot wu_{in}(n)$. The second product is added to the sixth product by a second adder 1916 to generate the combined uncorrelated component.

In step 1810, the combined correlated component is added to the combined uncorrelated component to generate an overlapped signal. For example, as shown in FIG. 19, the combined correlated component is added to the combined uncorrelated component by a third adder 1918, to generate the overlapped signal, shown as signal 1920.

3. Third Embodiment

Overlapping a Mixed Signal with a Mixed Signal

In this embodiment, both overlapping signals are not decomposed. Once again, a desired solution is to decompose both signals and use the first embodiment of subsection C.1 above. However, for most applications, this is not required. In an embodiment, an adequate compromise solution is given by the following equation (Equation C.3):

$$s(n)=[s_{out}(n)\cdot wc_{out}(n)+s_{in}(n)\cdot wc_{in}(n)]\beta+n=0\ldots N-1$$

$$[s_{out}(n)\cdot wu_{out}(n)+s_{in}(n)\cdot wu_{in}(n)]\cdot(1-\beta)$$

where β is an estimate of the cross-correlation between $s_{out}$ and $s_{in}$. Again, notice that if the signals are completely correlated (β=1) or completely uncorrelated (β=0), the solution is optimal.

Figure 20:
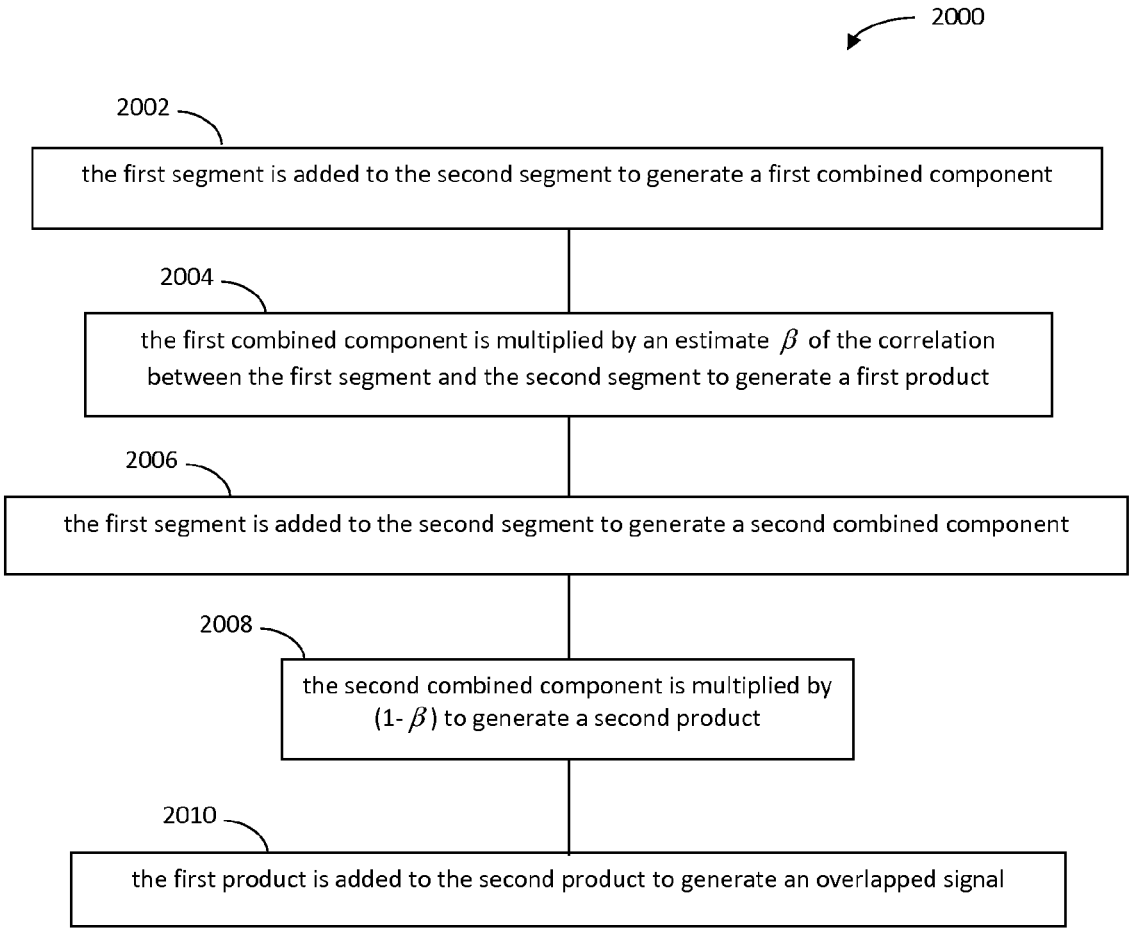
FIG. 20 shows a flowchart providing example steps for overlapping a mixed first signal with a mixed second signal, according to an embodiment of the present invention.
Figure 21:
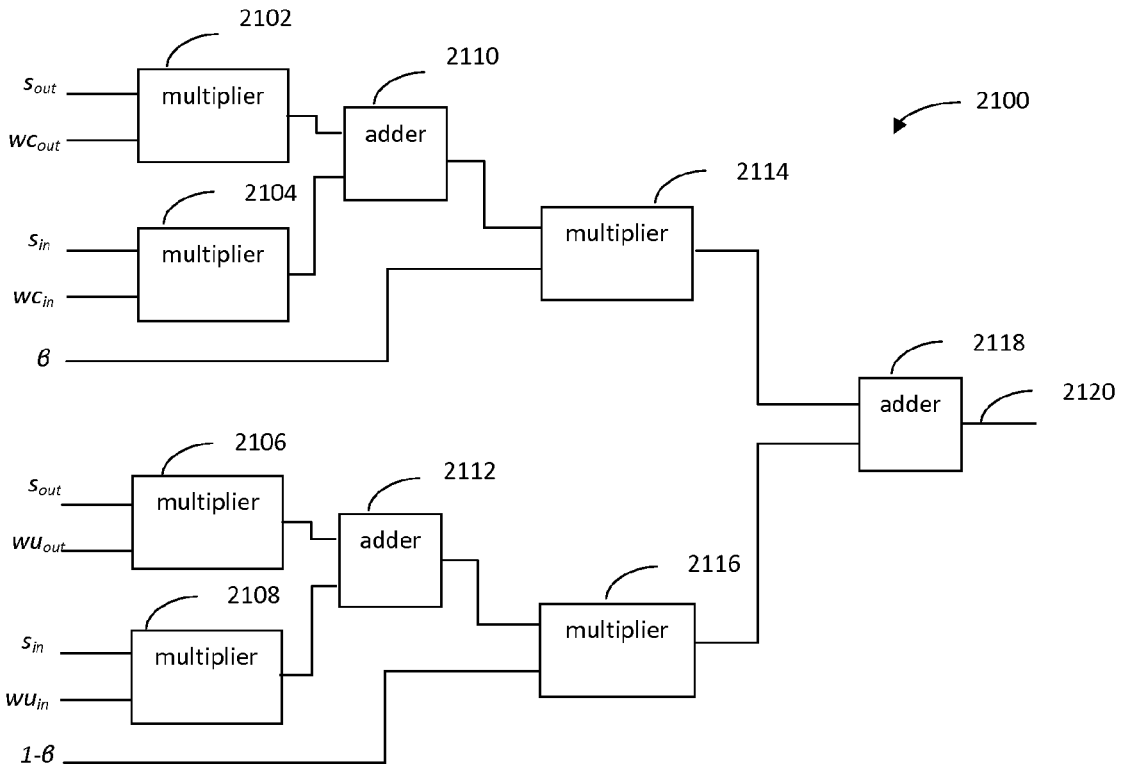
FIG. 21 shows a system configured to overlap a mixed first signal with a mixed second signal, according to an example embodiment of the present invention.

FIG. 20 shows a flowchart 2000 providing example steps for overlapping a mixed first signal with a mixed second signal according to the above Equation C.3. The steps of flowchart 2000 need not necessarily occur in the order shown in FIG. 20. Other structural and operational embodiments will be apparent to persons skilled in the relevant art(s) based on the discussion provided herein. For example, FIG. 21 shows a system 2100 configured to implement Equation C.3, according to an embodiment of the present invention. Flowchart 2000 is described as follows with respect to FIG. 21, for illustrative purposes.

Flowchart 2000 begins with step 2002. In step 2002, the first segment is added to the second segment to generate a first combined component. For example, as shown in FIG. 21, the first segment, $s_{out}(n)$, is multiplied with a correlated fade-out window, $wc_{out}(n)$, by a first multiplier 2102, to generate a third product, $s_{out}(n)\cdot wc_{out}(n)$. The second segment, $s_{in}(n)$, is multiplied with a correlated fade-in window, $wc_{in}(n)$, by a second multiplier 2104, to generate a fourth product, $s_{in}(n)\cdot wc_{in}(n)$. The third product is added to the fourth product by a first adder 2110 to generate the first combined component.

In step 2004, the first combined component is multiplied by an estimate β of the correlation between the first segment and the second segment to generate a first product. For example, as shown in FIG. 21, the first combined component is multiplied with β by a third multiplier 2114 to generate the first product.

In step 2006, the first segment is added to the second segment to generate a second combined component. For example, as shown in FIG. 21, the first segment, $s_{out}(n)$, is multiplied with an uncorrelated fade-out window, $wu_{out}(n)$, by a fourth multiplier 2106, to generate a fifth product. The second segment, $s_{in}(n)$, is multiplied with an uncorrelated fade-in window, $wu_{in}(n)$, by a fifth multiplier 2108, to generate a sixth product, $s_{in}(n)\cdot wu_{in}(n)$. The fifth product is added to the sixth product by a second adder 2112 to generate the second combined component.

In step 2008, the second combined component is multiplied by (1−β) to generate a second product. For example, as shown in FIG. 21, the second combined component is multiplied with (1−β) by a sixth multiplier 2116 to generate the second product.

In step 2010, the first product is added to the second product to generate an overlapped signal. For example, as shown in FIG. 21, the first product is added to the second product by third adder 2118, to generate the overlapped signal, shown as signal 2120.

D. Decimated Bisectional Pitch Refinement in Accordance with an Embodiment of the Present Invention Embodiments for determining pitch period are described below. Such embodiments may be used by processing block 161 shown in FIG. 1, and described above in Section A. However, embodiments are not limited to that application. The example embodiments described herein are provided for illustrative purposes, and are not limiting. Further structural and operational embodiments, including modifications/alterations, will become apparent to persons skilled in the relevant art(s) from the teachings herein.

An embodiment of the present invention uses the following procedure to refine a pitch period estimate based on a coarse pitch. The normalized correlation at the coarse pitch lag is calculated and used as a current best candidate. The normalized correlation is then evaluated at the midpoint of the refinement pitch range on either side of the current best candidate. If the normalized correlation at either midpoint is greater than the current best lag, the midpoint with the maximum correlation is selected as the current best lag. After each iteration, the refinement range is decreased by a factor of two and centered on the current best lag. This bisectional search continues until the pitch has been refined to an acceptable tolerance or until the refinement range has been exhausted. During each step of the bisectional pitch refinement, the signal is decimated to reduce the complexity of computing the normalized correlation. The decimation factor is chosen such that enough time resolution is still available to select the correct lag at each step. Hence, the decimated signal contains increasing time resolution as the bisectional search refines the pitch and reduces the search range.

Figure 22:
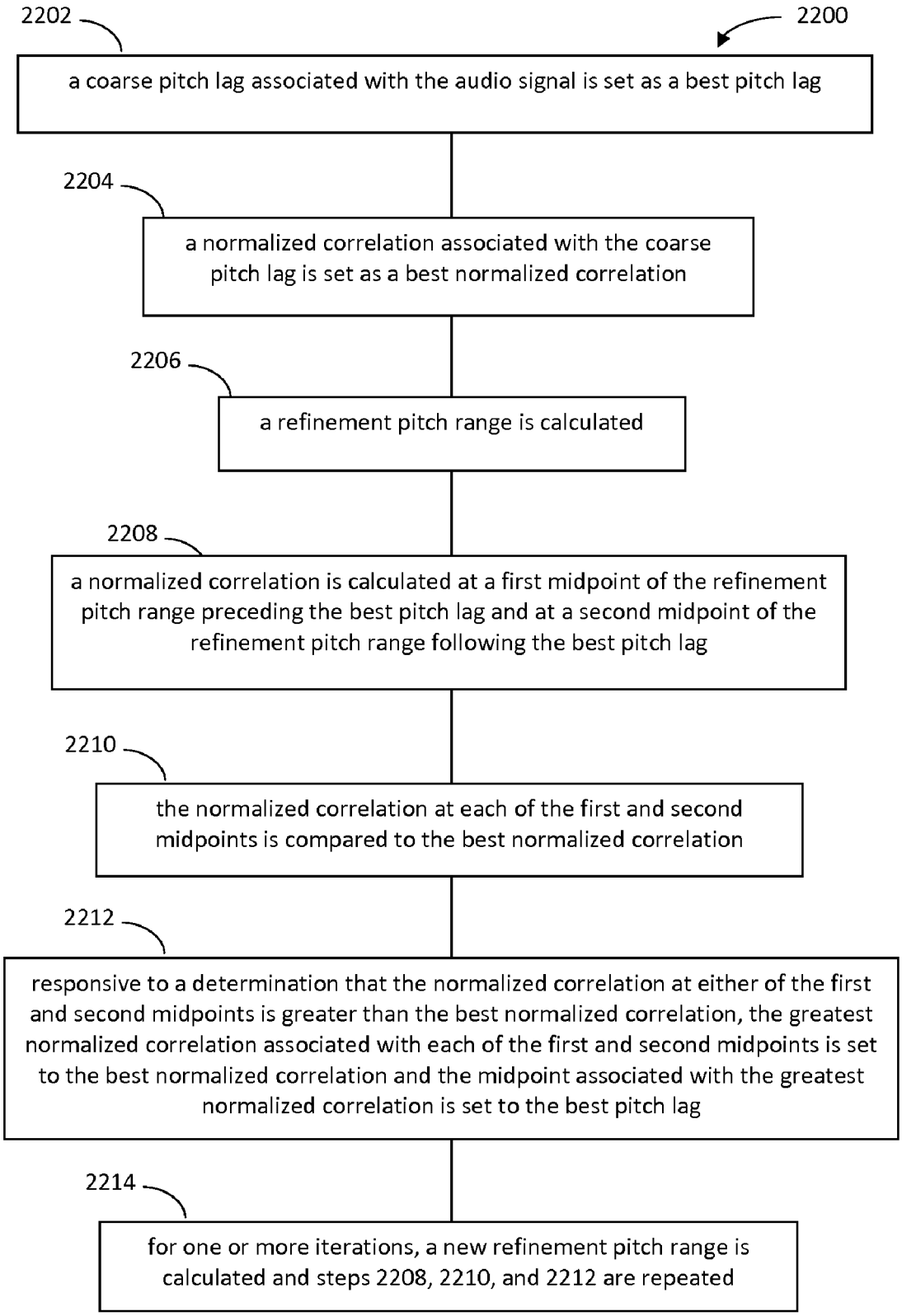
FIG. 22 shows a flowchart providing example steps for determining a pitch period of an audio signal, according to an example embodiment of the present invention.
Figure 23:
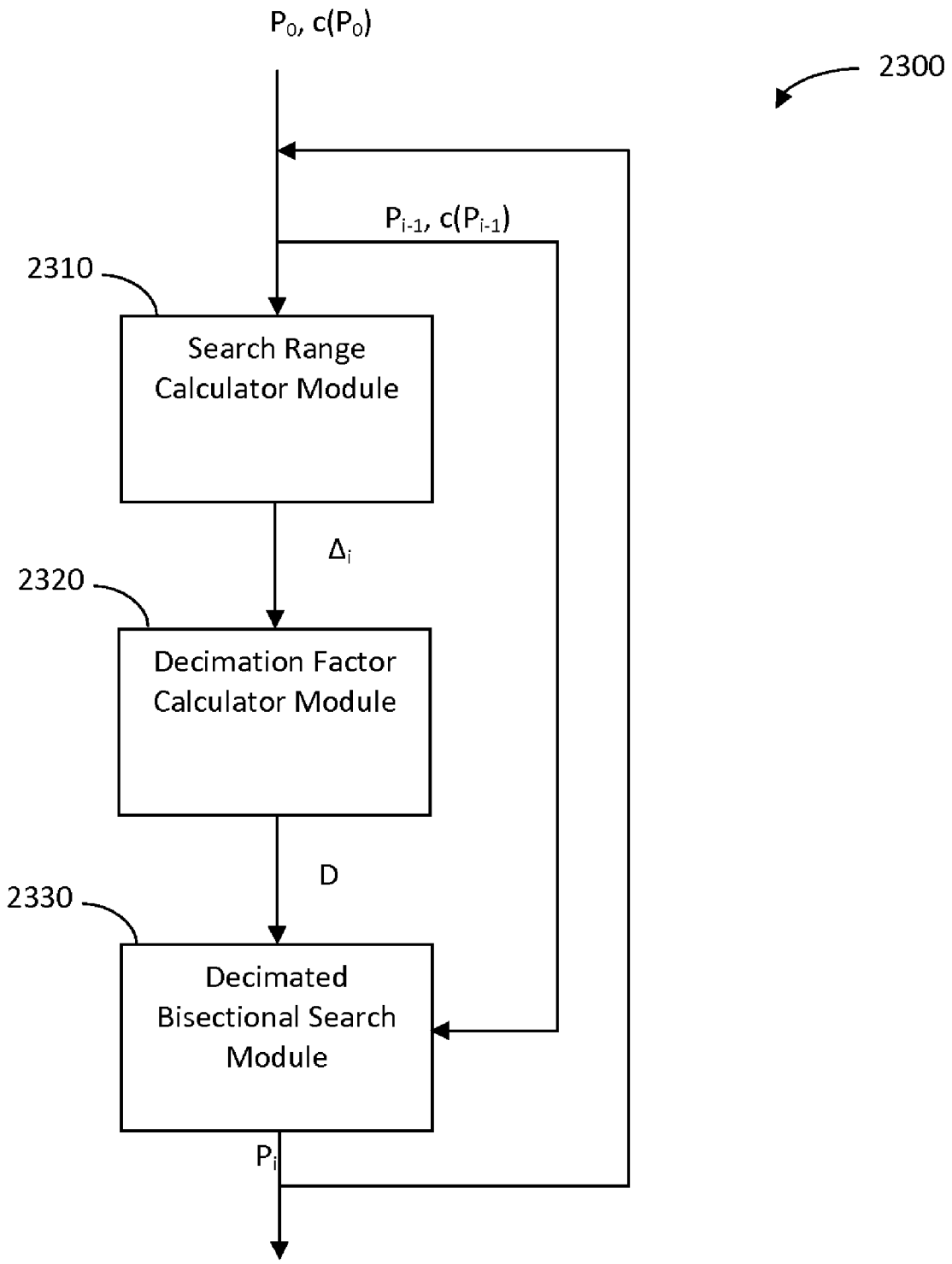
FIG. 23 shows block diagram of a pitch refinement system, in accordance with an example embodiment of the present invention.

FIG. 22 shows a flowchart 2200 providing example steps for determining a pitch period of an audio signal, according to an example embodiment of the present invention. Flowchart 2200 may be performed by processing block 161, for example. Other structural and operational embodiments will be apparent to persons skilled in the relevant art(s) based on the discussion provided herein. Flowchart 2200 is described as follows with respect to FIG. 23. FIG. 23 shows block diagram of a pitch refinement system 2300 in accordance with an example embodiment of the present invention. As shown in FIG. 23, pitch refinement system 2300 includes a search range calculator module 2310, a decimation factor calculator module 2320, and a decimated bisectional search module 2330. Note that modules 2310, 2320, and 2330 may be implemented in hardware, software, firmware, or any combination thereof. For example, modules 2310, 2320, and 2330 may be implemented in logic, such as a programmable logic chip (PLC), in a programmable gate array (PGA), in a digital signal processor (DSP), as software instructions that execute in a processor, etc.

Flowchart 2200 begins with step 2202. In step 2202, a coarse pitch lag associated with the audio signal is set as a best pitch lag. The initial pitch estimate, also referred to as a "coarse pitch," is denoted $P_0$. The coarse pitch may be a pitch value from a prior received signal frame used as a best pitch lag estimate, or the coarse pitch may be obtained by other ways.

In step 2204, a normalized correlation associated with the coarse pitch lag is set as a best normalized correlation. In an embodiment, the normalized correlation at $P_0$ is denoted by $c(P_0)$, and is calculated according to:

$$c(k) = \frac{\sum_{n=1}^{M} x(n)x(n-k)}{\sqrt{\sum_{n=1}^{M} x^2(n)}\sqrt{\sum_{n=1}^{M} x^2(n-k)}}$$

where M is the pitch analysis window length. The parameters $P_0$ and $c(P_0)$ are assumed to be available before the pitch refinement is performed in subsequent steps. The normalized correlation may be calculated by one of modules 2310, 2320, 2330 or other module not shown in FIG. 23 (e.g., a normalized correlation calculator module).

In step 2206, a refinement pitch range is calculated. For example, search range calculator module 2310 shown in FIG. 23 calculates the search range for the current iteration. As shown in FIG. 23, search range calculator 2310 receives P0 and c(P0). The initial search range is selected while considering the accuracy of the initial pitch estimate. In an embodiment, the initial range $\Delta_0$ is chosen as follows:

$$\Delta_0=\lfloor(1+|(P_{ideal}-P_0)|/2)\rfloor$$

where $P_{ideal}$ is the ideal pitch. Then for each iteration, in an embodiment, a range for the iteration (i) is calculated based on the previous iteration (i−1) according to:

$$\Delta i=\lfloor\Delta_{i-1}/2\rfloor.$$

In other embodiments, $\Delta_{i-1}$ may be divided by factors other than 2 to determine $\Delta_i$. As shown in FIG. 23, search range calculator module 2310 outputs $\Delta_i$.

In step 2208, a normalized correlation is calculated at a first midpoint of the refinement pitch range preceding the best pitch lag and at a second midpoint of the refinement pitch range following the best pitch lag. In an embodiment, a decimated bisectional search is conducted to hone in a best pitch lag. As shown in FIG. 23, decimation factor calculator module 2320 receives $\Delta_i$. Decimation factor calculator module 2320 calculates a decimation factor, D, according to:

$$D_i \leq \Delta_i.$$

If $D_i > \Delta_i$ then the time resolution of decimated signal is not sufficient to guarantee convergence of the bisectional search. As shown in FIG. 23, decimation factor calculator module 2320 outputs decimation factor D.

Figure 24:
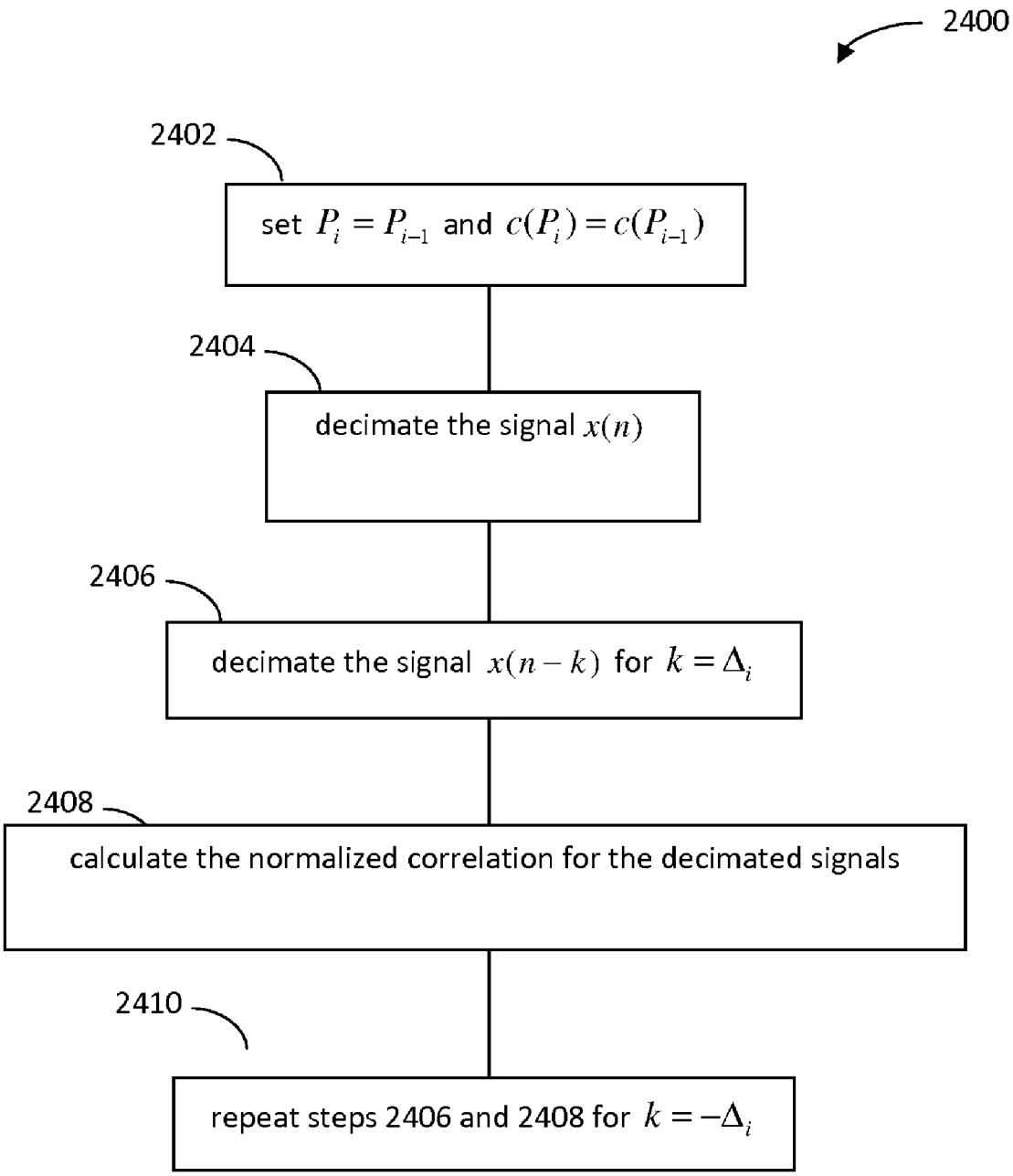
FIG. 24 shows a flowchart for performing a decimated bisectional search, according to an example embodiment of the present invention.

As shown in FIG. 23, decimated bisectional search module 2330 receives decimation factor D, $P_{i-1}$, and $c(P_{i-1})$. Decimated bisectional search module 2330 performs the decimated bisectional search. In an embodiment, decimated bisectional search module 2330 performs the steps of flowchart 2400 shown in FIG. 24 to perform step 2208 of FIG. 22.

In step 2402, set $P_i=P_{i-1}$ and $c(P_i)=c(P_{i-1})$.

In step 2404, decimate the signal x(n). Let D(·) represent a decimator with decimation factor D. Then $$xd(m)=D(x(n)).$$

In step 2406, decimate the signal x(n−k) for $k=\Delta_i$:

$$xd_k(m)=D(x(n-k)).$$

In step 2408, calculate the normalized correlation for the decimated signals. For example, the normalized correlation may be calculated according to:

$$c_d(k) = \frac{\sum_{m=1}^{\lfloor M/k \rfloor} xd(m)xd_k(m)}{\sqrt{\sum_{m=1}^{\lfloor M/k \rfloor} xd^2(m)}\sqrt{\sum_{m=1}^{\lfloor M/k \rfloor} xd_k^2(m)}}.$$

In step 2410, repeat steps 2406 and 2408 for $k=-\Delta_i$.

In step 2210 shown in FIG. 22, the normalized correlation at each of the first and second midpoints is compared to the best normalized correlation. In step 2212, responsive to a determination that the normalized correlation at either of the first and second midpoints is greater than the best normalized correlation, the greatest normalized correlation associated with each of the first and second midpoints is set to the best normalized correlation and the midpoint associated with the greatest normalized correlation is set to the best pitch lag.

In an embodiment, decimated bisectional search module 2330 performs steps 2210 and 2212 as follows. Separately for both of $k=\Delta_i$ and $k=-\Delta_i$, the correlation results of step 2408 are compared as follows, and an update to best normalized correlation and midpoint is made if necessary, as follows:

If $c_d(k)>c(P_i)$ then $c(P_i)=c_d(k)$ and $P_i=P_{i-1}+k$

In step 2214, for one or more additional iterations, a new refinement pitch range is calculated and steps 2208, 2210, and 2212 are repeated. Step 2214 may perform as many additional iterations as necessary, until no further decimation is practical, until an acceptable pitch value is determined, etc. As shown in FIG. 23, decimated bisectional search module 2330 outputs pitch estimate $P_i$.

In steps 2404 and 2406 of flowchart 2400, the input signal and a shifted version of the input signal are decimated. In a traditional decimator, the signal is first lowpass filtered in order to avoid aliasing in the decimated domain. To reduce complexity, the lowpass filtering step may be omitted and still achieve near equivalent results, especially in voiced speech where the signal is generally lowpass. The aliasing rarely alters the normalized correlation enough to affect the result of the search. In this case, the decimated signal is given by:

$$xd(m) = x(m \cdot D) \quad \text{and}$$

$$c_d(k) = \frac{\sum_{m=1}^{\lfloor M/k \rfloor} x(m \cdot D)x(m \cdot D - k)}{\sqrt{\sum_{m=1}^{\lfloor M/k \rfloor} x^2(m \cdot D)} \sqrt{\sum_{m=1}^{\lfloor M/k \rfloor} x^2(m \cdot D - k)}}$$

An example of the iterative process of flowchart 2200 is illustrated in FIGS. 25A-25D. FIGS. 25A-25D show plots of normalized correlation values ($c_d(k)$) versus values of k. For the initial conditions of the search, $P=\Delta_0=16$, and $c_d(P_i)$ is calculated.

Figure 25A:
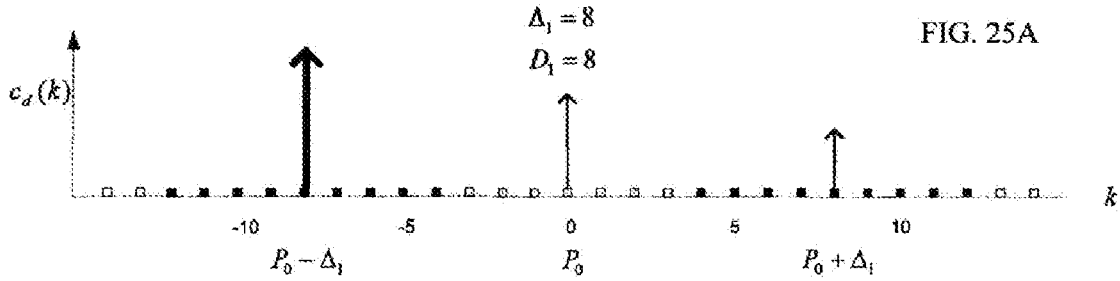
FIGS. 25A-25D show plots related to an example determination of a pitch period, in accordance with an embodiment of the present invention.

In the first iteration shown in FIG. 25A, $\Delta_i=D_i=8$, and $c_d(P_0\pm8)$ is evaluated on the decimated signal. The time resolution of the decimated correlation is noted by the darkened sample points. The candidate that maximizes $c_d(k)$ is $P_0-8$ and is selected as P.

Figure 25B:
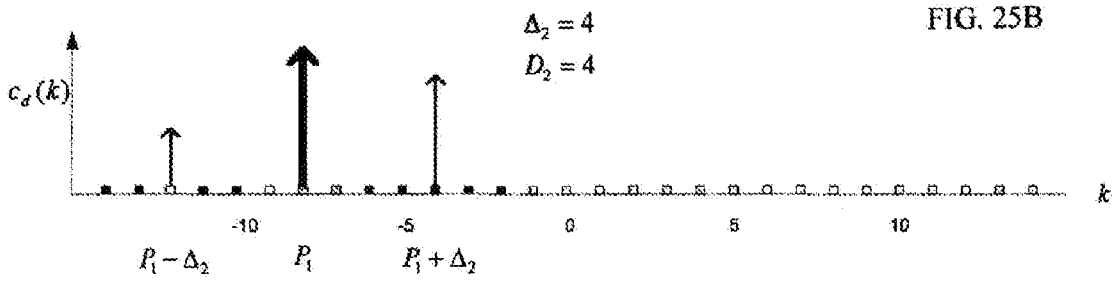

In the second iteration, shown in FIG. 25B, $\Delta_i=D_i=4$, and the search is centered around $P_1$. This time, neither candidate at $c_d(P_1\pm4)$ is greater than $c_d(P_1)$, and so $P_2=P_1$.

Figure 25C:
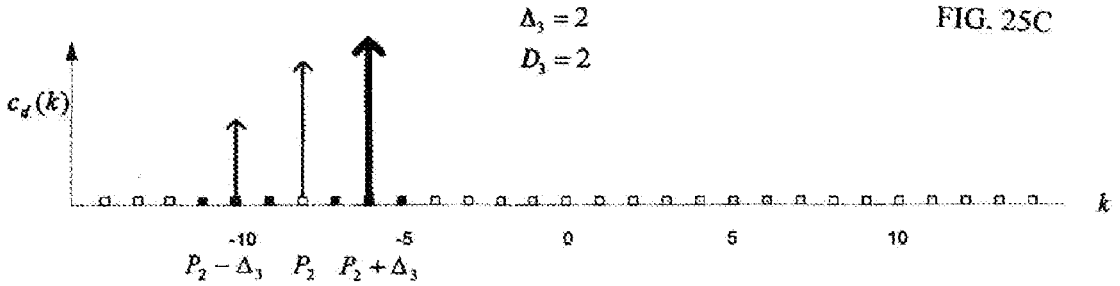

In the third iteration, shown in FIG. 25C, $\Delta_i=D_i=2$, and the search is centered around $P_2(P_1)$. The candidate that maximizes $c_d(k)$ is $P_2\pm2$, and is selected as $P_3$.

Figure 25D:
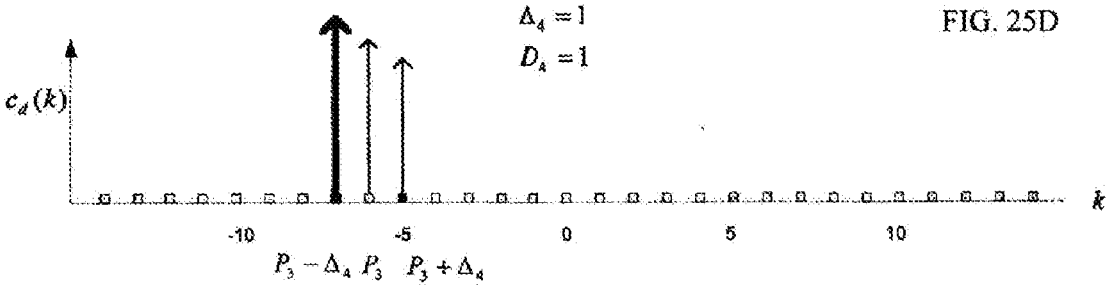

In the fourth iteration, shown in FIG. 25D, $\Delta_i=D_i=1$ (hence no decimation) and the search is centered around $P_3$. The candidate at $P_0-7$ ($P_3-1$) maximizes $c_d(k)$, and is selected as the final pitch value.

Note that the process of flowchart 2200 shown in FIG. 22 may be adapted to determining/refining parameters other than just a pitch period parameter. For example, in a process for refining a parameter (e.g., a generic parameter "Q") of a signal, an adapted step 2202 may include setting a coarse value for the parameter associated with the signal to a best parameter value. An adapted step 2204 may include setting a value of a function f(Q) associated with the coarse parameter value as a best function value. An adapted step 2206 may include calculating a refinement parameter range. An adapted step 2208 may include calculating a value of the function f(Q) at a first midpoint of the refinement parameter range preceding the best parameter value and at a second midpoint of the refinement parameter range following the best parameter value. An adapted step 2210 may include comparing the calculated function value at each of the first and second midpoints to the best function value. An adapted step 2212 may include, responsive to a determination that the calculated function value at either of the first and second midpoints is better than the best function value, setting the better function value associated with each of the first and second midpoints to the best function value and setting the midpoint associated with the better function value to the best parameter value.

Flowchart 2200 may be adapted in this manner just described, or in other ways, to determine/refine a variety of signal parameters, as would be known to persons skilled in the relevant art(s) from the teachings herein. For example, the bisectional decimation techniques described further above may be applied to the just described process of determining/refining parameters other than just a pitch period parameter. For example, the adapted step 2208 may include decimating the signal prior to computing a value of the function f(Q) at the midpoint of the refinement parameter range to either side of the best parameter value. This process of decimation may include calculating a decimation factor, where the decimation factor is less than or equal to the refinement parameter range. The techniques of bisectional decimation described herein may be further adapted to the present example of determining/refining parameters, as would be apparent to persons skilled in the relevant art(s) from the teachings herein.

E. Hardware and Software Implementations

Figure 26:
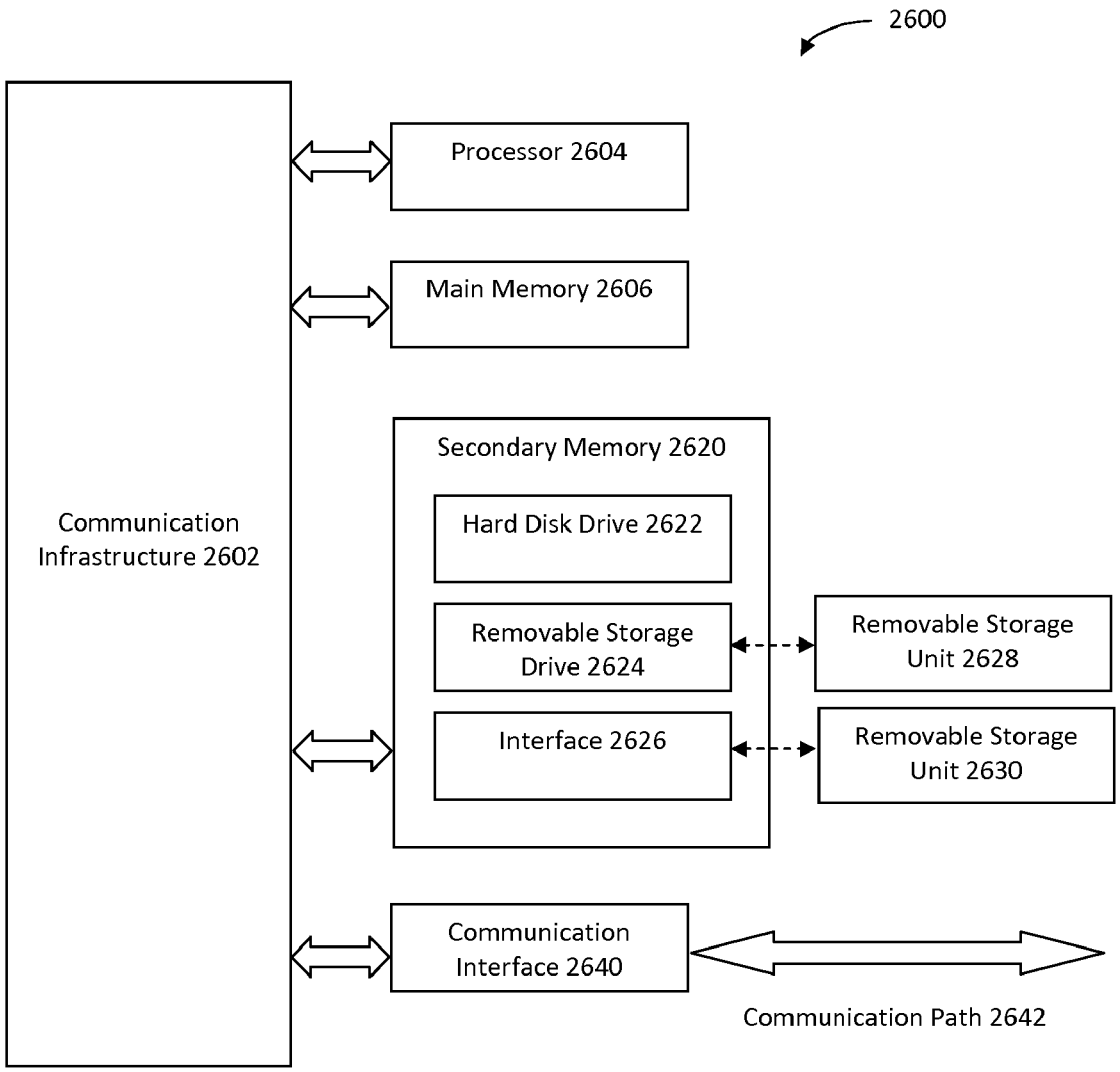
FIG. 26 is a block diagram of a computer system in which embodiments of the present invention may be implemented.

The following description of a general purpose computer system is provided for the sake of completeness. The present invention can be implemented in hardware, or as a combination of software and hardware. Consequently, the invention may be implemented in the environment of a computer system or other processing system. An example of such a computer system 2600 is shown in FIG. 26. In the present invention, all of the processing blocks or steps of FIGS. 1-24, for example, can execute on one or more distinct computer systems 2600, to implement the various methods of the present invention. The computer system 2600 includes one or more processors, such as processor 2604. Processor 2604 can be a special purpose or a general purpose digital signal processor. The processor 2604 is connected to a communication infrastructure 2602 (for example, a bus or network). Various software implementations are described in terms of this exemplary computer system. After reading this description, it will become apparent to a person skilled in the relevant art(s) how to implement the invention using other computer systems and/or computer architectures.

Computer system 2600 also includes a main memory 2606, preferably random access memory (RAM), and may also include a secondary memory 2620. The secondary memory 2620 may include, for example, a hard disk drive 2622 and/or a removable storage drive 2624, representing a floppy disk drive, a magnetic tape drive, an optical disk drive, or the like. The removable storage drive 2624 reads from and/or writes to a removable storage unit 2628 in a well known manner. Removable storage unit 2628 represents a floppy disk, magnetic tape, optical disk, or the like, which is read by and written to by removable storage drive 2624. As will be appreciated, the removable storage unit 2628 includes a computer usable storage medium having stored therein computer software and/or data.

In alternative implementations, secondary memory 2620 may include other similar means for allowing computer programs or other instructions to be loaded into computer system 2600. Such means may include, for example, a removable storage unit 2630 and an interface 2626. Examples of such means may include a program cartridge and cartridge interface (such as that found in video game devices), a removable memory chip (such as an EPROM, or PROM) and associated socket, and other removable storage units 2630 and interfaces

2626 which allow software and data to be transferred from the removable storage unit 2630 to computer system 2600.

Computer system 2600 may also include a communications interface 2640. Communications interface 2640 allows software and data to be transferred between computer system 2600 and external devices. Examples of communications interface 2640 may include a modem, a network interface (such as an Ethernet card), a communications port, a PCMCIA slot and card, etc. Software and data transferred via communications interface 2640 are in the form of signals which may be electronic, electromagnetic, optical, or other signals capable of being received by communications interface 2640. These signals are provided to communications interface 2640 via a communications path 2642. Communications path 2642 carries signals and may be implemented using wire or cable, fiber optics, a phone line, a cellular phone link, an RF link and other communications channels.

As used herein, the terms "computer program medium" and "computer usable medium" are used to generally refer to media such as removable storage units 2628 and 2630, a hard disk installed in hard disk drive 2622, and signals received by communications interface 2640. These computer program products are means for providing software to computer system 2600.

Computer programs (also called computer control logic) are stored in main memory 2606 and/or secondary memory 2620. Computer programs may also be received via communications interface 2640. Such computer programs, when executed, enable the computer system 2600 to implement the present invention as discussed herein. In particular, the computer programs, when executed, enable the processor 2600 to implement the processes of the present invention, such as any of the methods described herein. Accordingly, such computer programs represent controllers of the computer system 2600. Where the invention is implemented using software, the software may be stored in a computer program product and loaded into computer system 2600 using removable storage drive 2624, interface 2626, or communications interface 2640.

In another embodiment, features of the invention are implemented primarily in hardware using, for example, hardware components such as Application Specific Integrated Circuits (ASICs) and gate arrays. Implementation of a hardware state machine so as to perform the functions described herein will also be apparent to persons skilled in the relevant art(s).

F. Conclusion

While various embodiments of the present invention have been described above, it should be understood that they have been presented by way of example, and not limitation. It will be apparent to persons skilled in the relevant art that various changes in form and detail can be made therein without departing from the spirit and scope of the invention.

The present invention has been described above with the aid of functional building blocks and method steps illustrating the performance of specified functions and relationships thereof. The boundaries of these functional building blocks and method steps have been arbitrarily defined herein for the convenience of the description. Alternate boundaries can be defined so long as the specified functions and relationships thereof are appropriately performed. Any such alternate boundaries are thus within the scope and spirit of the claimed invention. One skilled in the art will recognize that these functional building blocks can be implemented by discrete components, application specific integrated circuits, processors executing appropriate software and the like or any combination thereof.

Furthermore, the description of the present invention provided herein references various numerical values, such as various minimum values, maximum values, threshold values, ranges, and the like. It is to be understood that such values are provided herein by way of example only and that other values may be used within the scope and spirit of the present invention.

In accordance with the foregoing, the breadth and scope of the present invention should not be limited by any of the above-described exemplary embodiments, but should be defined only in accordance with the following claims and their equivalents.

What is claimed is:

1. A method for refining an estimated pitch period associated with an audio signal, comprising:

(a) setting an initial coarse pitch lag ($P_0$) associated with the audio signal as a best pitch lag;

(b) setting a normalized correlation associated with the initial coarse pitch lag as a best normalized correlation;

(c) calculating a refinement pitch range based on an ideal pitch and the initial coarse pitch lag;

(d) calculating a normalized correlation at a first midpoint of the refinement pitch range preceding the best pitch lag and at a second midpoint of the refinement pitch range following the best pitch lag;

(e) comparing the normalized correlation at each of the first and second midpoints to the best normalized correlation; and (f) responsive to a determination that the normalized correlation at either of the first and second midpoints is greater than the best normalized correlation, setting the greatest normalized correlation associated with each of the first and second midpoints to the best normalized correlation and setting the midpoint associated with the greatest normalized correlation to the best pitch lag.

2. The method of claim 1, further comprising:

for one or more iterations, calculating a new refinement pitch range by dividing the current refinement pitch range by two and then repeating steps (d), (e) and (f).

3. The method of claim 1, wherein step (d) further comprises:

decimating the audio signal prior to computing a normalized correlation at the midpoint of the refinement pitch range to either side of the best pitch lag.

4. The method of claim 3, wherein decimating the audio signal comprises calculating a decimation factor, wherein the decimation factor is less than or equal to the refinement pitch range.

5. The method of claim 1, wherein step (b) comprises:

calculating the normalized correlation, c(P), according to:

$$c(P) = \frac{\sum_{n=1}^{M} x(n)x(n-P)}{\sqrt{\sum_{n=1}^{M} x^2(n)}\sqrt{\sum_{n=1}^{M} x^2(n-P)}}$$

where:

P is the pitch lag and is set equal to $P_0$ in step (b); and

M is the pitch analysis window length.

6. The method of claim 5, wherein step (c) comprises:

selecting the initial refinement pitch range, $\Delta_0$, according to:

$$\Delta_0=\lfloor(1+|P_{ideal}-P_0|/2)\rfloor,$$

where $P_{ideal}$ is an ideal pitch; and $P_0$ is the initial pitch lag estimate.

7. The method of claim 2, wherein calculating the new refinement pitch range comprises:

calculating the refinement pitch range $\Delta_i$ for a current iteration i according to:

$$\Delta_i=\lfloor\Delta_{i-1}/2\rfloor,$$

where $\Delta_{i-1}$ is a refinement pitch range for a previous iteration i−1.

8. A system for refining an estimated pitch period associated with an audio signal, comprising:

a normalized correlation calculator module configured to store a coarse pitch lag associated with the audio signal as a best pitch lag, and to calculate a normalized correlation associated with a the coarse pitch lag as a best normalized correlation;

a search range calculator module, at least partially implemented in hardware, configured to calculate a refinement pitch range based on an ideal pitch and the coarse pitch lag; and a decimated bisectional search module configured to calculate a normalized correlation at a first midpoint of the refinement pitch range preceding the best pitch lag and at a second midpoint of the refinement pitch range following the best pitch lag;

wherein the decimated bisectional search module is further configured to compare the normalized correlation at each of the first and second midpoints to the best normalized correlation; and wherein the decimated bisectional search module is further configured, responsive to a determination that the normalized correlation at either of the first and second midpoints is greater than the best normalized correlation, to set the greatest normalized correlation associated with each of the first and second midpoints to the best normalized correlation and to set the midpoint associated with the greatest normalized correlation to the best pitch lag.

9. The system of claim 8, wherein for one or more iterations, the search range calculator module is configured to calculate a new refinement pitch range by dividing the current refinement pitch range by two; and the decimated bisectional search module is configured to calculate a normalized correlation at a first midpoint of the new refinement pitch range preceding the best pitch lag and at a second midpoint of the new refinement pitch range following the best pitch lag.

10. The system of claim 8, wherein the decimated bisectional search module is further configured to decimate the audio signal prior to calculation of the normalized correlation at the midpoint of the refinement pitch range to either side of the best pitch lag.

11. The system of claim 10, further comprising:

a decimation factor calculator module configured to calculate a decimation factor, wherein the decimation factor is less than or equal to the refinement pitch range.

12. The system of claim 8, wherein the normalized correlation calculator module is configured to calculate the normalized correlation, c(P), according to:

$$c(P)=\frac{\sum_{n=1}^{M}x(n)x(n-P)}{\sqrt{\sum_{n=1}^{M}x^2(n)}\sqrt{\sum_{n=1}^{M}x^2(n-P)}}$$

where:

P is the current pitch lag estimate; and

M is the pitch analysis window length.

13. The system of claim 12, wherein the search range calculator module is configured to select the initial refinement pitch range, $\Delta_0$, according to:

$$\Delta_0=\lfloor(1+|P_{ideal}-P_0/2)\rfloor,$$

where $P_{ideal}$ is an ideal pitch; and $P_0$ is the initial pitch lag estimate.

14. The system of claim 9, wherein the search range calculator module is configured to calculate a refinement pitch range $\Delta_i$ for a current iteration i according to:

$$\Delta_i=\lfloor\Delta_{i-1}/2\rfloor,$$

where $\Delta_{i-1}$ is a refinement pitch range for a previous iteration i−1.

15. A method for refining a parameter Q associated with a signal by the function f(Q), the parameter Q having a coarse value $Q_0$, and a value for a function $f(Q_0)$ associated with the coarse parameter $Q_0$ value being set as an initial best function value, the method comprising:

(a) calculating a refinement parameter range based on an ideal value for the parameter Q and the coarse parameter $Q_0$ value;

(b) calculating a value of the function f(Q) at a first midpoint of the refinement parameter Q range preceding the best parameter Q value and at a second midpoint of the refinement parameter Q range following the best parameter Q value;

(c) comparing the calculated function value at each of the first and second midpoints to the best function value; and (d) responsive to a determination that the calculated function value at either of the first and second midpoints is better than the best function value, setting the better function value associated with each of the first and second midpoints to the best function value and setting the midpoint associated with the better function value to the best parameter Q value, using a processor.

16. The method of claim 15, further comprising:

for one or more iterations, calculating a new refinement parameter Q range by dividing the current refinement parameter Q range by two and then repeating steps (b), (c) and (d).

17. The method of claim 15, wherein step (b) further comprises:

decimating the signal prior to computing a value of the function f(Q) at the midpoint of the refinement parameter Q range to either side of the best parameter Q value.

18. The method of claim 17, wherein decimating the signal comprises calculating a decimation factor, wherein the decimation factor is less than or equal to the refinement parameter Q range.

19. The method of claim 15, wherein step (a) comprises:

selecting an initial refinement parameter Q range, $\Delta_0$, according to:

$$\Delta_0=\lfloor(1+Q_{ideal}-Q_0|/2)\rfloor,$$

where $Q_0$ is the initial estimate of $Q_{ideal}$; and $Q_{ideal}$ is an ideal value for the parameter Q.

20. The method of claim 16, wherein calculating the new refinement parameter Q range comprises:

calculating the refinement parameter Q range $\Delta_i$ for a current iteration i according to:

$$\Delta_i = \lfloor \Delta_{i-1}/2 \rfloor,$$

where $\Delta_{i-1}$ is a refinement parameter Q range for a previous iteration i−1.

21. The method of claim 15, wherein step (d) comprises:

determining that the calculated function value at either of the first and second midpoints is better than the best function value because the calculated function value at either of the first and second midpoints is greater than the best function value.

22. The method of claim 15, wherein step (d) comprises:

determining that the calculated function value at either of the first and second midpoints is better than the best function value because the calculated function value at either of the first and second midpoints is less than the best function value.

23. A system for refining a parameter Q associated with a signal, the system comprising:

a function calculator module configured to store a coarse value $Q_0$ for the parameter Q as a best parameter Q value, and to calculate a value $f(Q_0)$ for a function f(Q) associated with the coarse parameter $Q_0$ value as a best function value;

a search range calculator module, at least partially implemented in hardware, configured to calculate a refinement parameter Q range based on an ideal value for the parameter Q and the coarse parameter $Q_0$ value; and a decimated bisectional search module configured to calculate a value for the function f(Q) at a first midpoint of the refinement parameter Q range preceding the best parameter Q value and at a second midpoint of the refinement parameter Q range following the best parameter Q value;

wherein the decimated bisectional search module is further configured to compare the calculated value for the function f(Q) at each of the first and second midpoints to the best function value; and wherein the decimated bisectional search module is further configured, responsive to a determination that the calculated value of the function f(Q) at either of the first and second midpoints is better than the best function value, to set the better function value associated with each of the first and second midpoints to the best function value and to set the midpoint associated with the better function value to the best parameter Q value.

24. The system of claim 23, wherein for one or more iterations, the search range calculator module is configured to calculate a new refinement parameter Q range by dividing the current refinement parameter Q range by two; and the decimated bisectional search module is configured to calculate a value for the function f(Q) at a first midpoint of the new refinement parameter Q range preceding the best parameter Q value and at a second midpoint of the new refinement parameter Q range following the best parameter Q value.

25. The system of claim 23, wherein the decimated bisectional search module is further configured to decimate the signal prior to calculation of the value of the function f(Q) at the midpoint of the refinement parameter Q range to either side of the best parameter Q value.

26. The system of claim 25, further comprising:

a decimation factor calculator module configured to calculate a decimation factor, wherein the decimation factor is less than or equal to the refinement parameter Q range.

27. The system of claim 23, wherein the search range calculator module is configured to select an initial refinement parameter Q range, $\Delta_0$, according to:

$$\Delta_0 = \lfloor (1 + Q_{ideal} - Q_0 / 2) \rfloor,$$

where $Q_0$ is the initial or coarse estimate of $Q_{ideal}$; and $Q_{ideal}$ is an ideal value for the parameter Q.

28. The system of claim 25, wherein the search range calculator module is configured to calculate a refinement parameter Q range $\Delta_i$ for a current iteration i according to:

$$\Delta_i = \lfloor \Delta_{i-1}/2 \rfloor,$$

where $\Delta_{i-1}$ is a refinement parameter Q range for a previous iteration i−1.

29. The system of claim 23, wherein the function f(Q) is monotonically increasing or decreasing around a single maximum or minimum within the bounds of the initial refinement range $\Delta_0$.

30. The system of claim 23, wherein decimated bisectional search module is configured to determine that the calculated function value at either of the first and second midpoints is better than the best function value by determining whether the function value at either of the first and second midpoints is greater than the best function value.

31. The system of claim 23, wherein decimated bisectional search module is configured to determine that the calculated function value at either of the first and second midpoints is better than the best function value by determining whether the function value at either of the first and second midpoints is less than the best function value.

* * * * *

UNITED STATES PATENT AND TRADEMARK OFFICE

CERTIFICATE OF CORRECTION

PATENT NO. : 8,010,350 B2
APPLICATION NO. : 11/734824
DATED : August 30, 2011
INVENTOR(S) : Robert W. Zopf It is certified that error appears in the above-identified patent and that said Letters Patent is hereby corrected as shown below:

IN THE CLAIMS:

In column 41, line 24, in claim 8, delete "a the" and insert -- the --, therefor.

In column 42, line 67, in claim 19, delete " $\Delta_0 = \lfloor (1 + Q_{ideal} - Q_0 | / 2) \rfloor$, " and insert -- $\Delta_0 = \lfloor (1 + |Q_{ideal} - Q_0| / 2) \rfloor$, --, therefor.

In column 44, line 23, in claim 27, delete " $\Delta_0 = \lfloor (1 + Q_{ideal} - Q_0 | / 2) \rfloor$, " and insert -- $\Delta_0 = \lfloor (1 + |Q_{ideal} - Q_0| / 2) \rfloor$, --, therefor.

Signed and Sealed this
Twenty-second Day of November, 2011

David J. Kappos

David J. Kappos
*Director of the United States Patent and Trademark Office*